US012708861B2

(12) United States Patent
Huang

(10) Patent No.: US 12,708,861 B2
(45) Date of Patent: Aug. 18, 2026

(54) TOY BALL

(71) Applicant: Changsha Mobile Electronic Technology Co., Ltd., Changsha City (CN)

(72) Inventor: Hui Huang, Changsha City (CN)

(73) Assignee: Changsha Mobile Electronic Technology Co., Ltd., Changsha City (CN)

( * ) Notice: Subject to any disclaimer, the term of this patent is extended or adjusted under 35 U.S.C. 154(b) by 223 days.

(21) Appl. No.: 18/777,053

(22) Filed: Jul. 18, 2024

(65) Prior Publication Data

US 2025/0058244 A1 Feb. 20, 2025

(30) Foreign Application Priority Data

Aug. 14, 2023 (CN) ..... 202311024352.6
Aug. 14, 2023 (CN) ..... 202322184350.5

(51) Int. Cl.
*A63H 33/26* (2006.01)
*A63H 33/22* (2006.01)

(52) U.S. Cl.
CPC ..... *A63H 33/22* (2013.01); *A63H 33/26* (2013.01)

(58) Field of Classification Search
CPC ..... A63H 33/22; A63H 33/26; A63B 43/00; A63B 43/06
See application file for complete search history.

(56) References Cited

U.S. PATENT DOCUMENTS 3,304,651 A * 2/1967 Deyerl ..... A63B 43/06 362/802
3,458,205 A * 7/1969 Douglas ..... A63B 43/06 362/208
5,236,383 A * 8/1993 Connelly ..... A63B 43/06 473/576
6,117,030 A * 9/2000 Green, Sr. ..... A63B 43/06 473/570
6,428,432 B1 * 8/2002 Kachel ..... A63B 43/06 473/570
6,575,855 B1 * 6/2003 Buzak ..... A63B 43/06 273/DIG. 8
6,666,782 B1 * 12/2003 Wu ..... A63H 33/22 446/485
7,261,432 B1 * 8/2007 Habitz ..... A63H 33/22 441/13
8,196,550 B2 * 6/2012 Levin ..... A63B 43/06 473/570

(Continued)

*Primary Examiner* — Kurt Fernstrom
(74) *Attorney, Agent, or Firm* — Withrow + Terranova, PLLC; Vincent K. Gustafson

(57) ABSTRACT

A toy ball includes: a first shell and a second shell capable of being fitted with each other and forming a cavity inside; a first mounting base, accommodated in the cavity; a support frame, disposed in the cavity and supporting the first shell and the second shell; a plurality of first light-emitting elements, spaced apart in the cavity in a circumferential direction at ends of the first shell and the second shell where they are fitted with each other, each of the first light-emitting elements being secured to the support frame; and a control device, mounted on the first mounting base and electrically connected to the first light-emitting elements. The toy ball of the present disclosure can reduce weight while maintaining its shape, and expand lighting effects.

20 Claims, 19 Drawing Sheets

(56) References Cited

U.S. PATENT DOCUMENTS

| | | | | |
|---|---|---|---|---|
| 9,279,557 | B2 * | 3/2016 | Su | F21V 3/02 |
| 10,159,874 | B1 * | 12/2018 | Lin | A63B 37/12 |
| 10,857,428 | B2 * | 12/2020 | Lin | A63B 37/06 |
| 11,559,725 | B1 * | 1/2023 | Ayal | A63B 43/06 |
| 11,786,835 | B1 * | 10/2023 | Xiong | A63H 33/26 446/267 |
| 2002/0137582 | A1 * | 9/2002 | Yu | A63B 43/06 473/570 |
| 2004/0220001 | A1 * | 11/2004 | Oister | A63B 37/0024 473/588 |
| 2005/0009650 | A1 * | 1/2005 | Sullivan, III | A63B 43/06 473/570 |
| 2006/0249096 | A1 * | 11/2006 | Gick | A01K 15/025 119/707 |
| 2007/0281811 | A1 * | 12/2007 | Wang | A63B 43/06 473/570 |
| 2015/0174459 | A1 * | 6/2015 | Won | A63B 41/00 473/570 |
| 2018/0043218 | A1 * | 2/2018 | Hu | A63B 41/00 |
| 2019/0133079 | A1 * | 5/2019 | Jang | A01K 15/025 |
| 2025/0195960 | A1 * | 6/2025 | Engler | F21V 15/01 |
| 2025/0260265 | A1 * | 8/2025 | Binder | H02J 50/10 |

* cited by examiner

TOY BALL

CROSS-REFERENCE TO RELATED APPLICATIONS

This application is based on and claims the benefit of priority from Chinese Patent Applications No. 2023110243526 and No. 2023221843505, both filed on 14 Aug. 2023, the entireties of which are incorporated by reference herein.

TECHNICAL FIELD

The present disclosure relates to the technical field of toys, and particularly relates to a toy ball.

BACKGROUND

With the improvement of people's living standards, the variety of toys has also increased. In the existing technology, toy balls, such as juggling balls and swing balls, are available. Taking a swing ball as an example, it is attached with a rope, allowing the player to hold the rope and swing the ball around him or her. By swinging the swing ball, one can not only play but also use it for dancing or exercising. In addition, in order to increase the fun, some lighting functions are added to toy balls such as juggling balls and swing balls. For example, lighting devices are added to the toy balls. The lighting devices in the existing technology typically only include one or two light beads mounted on a circuit board, resulting in a relatively simple structure with very limited lighting effects. Moreover, the main body of a toy ball in the existing technology is typically formed as an integrated structure through methods like 3D printing, making it relatively heavy and limiting the expansion of lighting effects.

SUMMARY

For the problems in the existing technology, the present disclosure proposes a toy ball that can reduce the weight while maintaining its shape, and expand lighting effects. In addition, the present disclosure also proposes a toy ball that can present richer lighting effects.

A toy ball in a first aspect of the present disclosure includes: a first shell and a second shell capable of being fitted with each other and forming a cavity inside; a first mounting base, accommodated in the cavity; a support frame, disposed in the cavity and supporting the first shell and the second shell; a plurality of first light-emitting elements, spaced apart in the cavity in a circumferential direction at ends of the first shell and the second shell where they are fitted with each other, each of the first light-emitting elements being secured to the support frame; and a control device, mounted on the first mounting base and electrically connected to the first light-emitting elements.

Beneficial Effects

The toy ball of the present disclosure can reduce the weight while maintaining its shape, and expand lighting effects.

A toy ball in a second aspect of the present disclosure includes: a first shell and a second shell capable of being fitted with each other and forming a cavity inside; a plurality of first light-emitting elements, spaced apart in the cavity in a circumferential direction at ends of the first shell and the second shell where they are fitted with each other; a first mounting base, accommodated in the cavity; and a control device, mounted on the first mounting base and electrically connected to the first light-emitting elements.

Beneficial Effects

The toy ball of the second aspect of the present disclosure can present richer lighting effects.

DESCRIPTION OF REFERENCE NUMERALS

Figure 1:
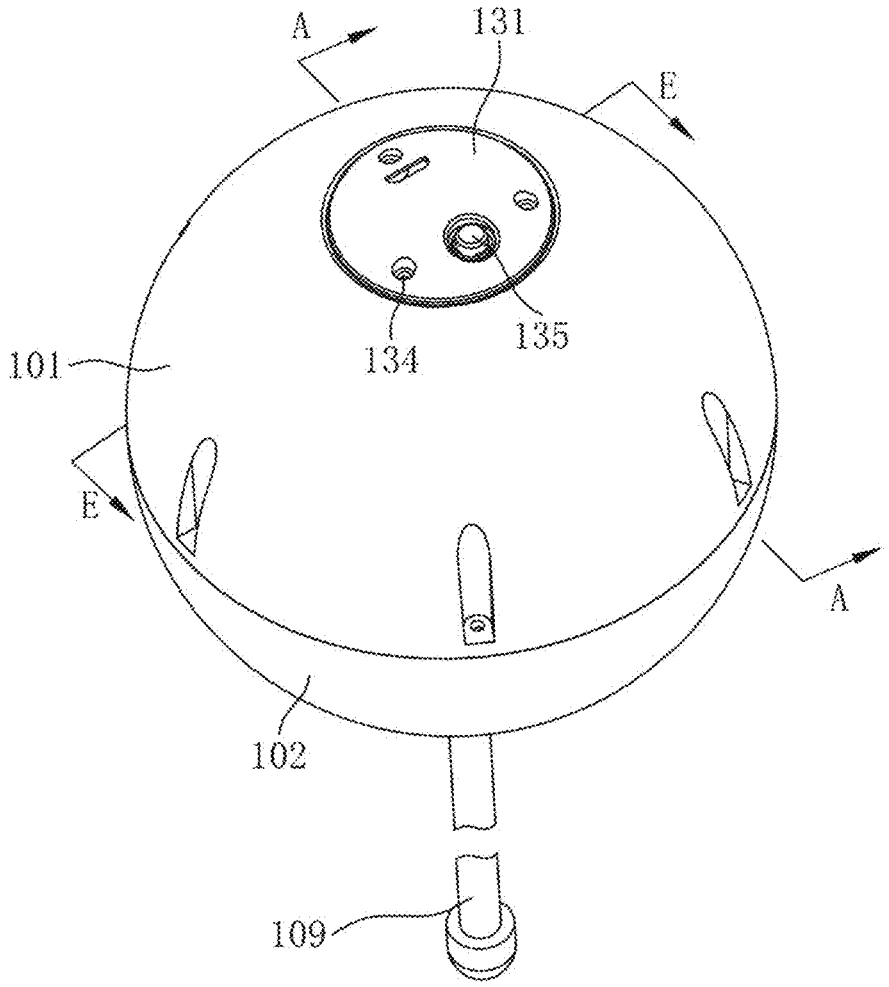
FIG. 1 is a schematic view of a toy ball in an embodiment.

101: first shell; 101*a*: first end; 101*b*: first bottom; 102: second shell; 102*a*: second end; 102*b*: second bottom; 103: first light-emitting element; 104: first mounting base; 105: control device; 106: cavity; 107: inner wall surface; 107*a*: first inner wall surface; 107*b*: second inner wall surface; 108: rope mounting portion; 109: rope; 110: first boss; 111: first hole; 112: first mounting cavity; 112*a*: battery mounting cavity; 112*b*: circuit board mounting cavity; 113: first mounting hole; 114: first side wall; 115: first notch; 116: circuit board; 117: first protrusion; 118: middle wall; 119: first mounting post; 120: support surface; 121: positioning portion; 122: first threaded hole; 123: second side wall; 124: corner portion; 125: arc portion; 126: first distal bottom; 127: thickened portion; 128: second threaded hole; 129: storage groove; 131: first cover; 132: second mounting post; 134: second hole; 135: control button; 136: avoidance portion; 137: second boss; 138: third threaded hole; 139: first locking element; 140: second mounting base; 141:

second mounting cavity; 142: second mounting hole; 102*b*: second bottom; 143: third side wall; 144: second notch; 145: second light-emitting element; 146: second protrusion; 147: fourth side wall; 148: second distal bottom; 150: first blocking portion; 151: first guide groove; 152: second locking element; 153: second cover; 154: fifth side wall; 155: second blocking portion; 156: third mounting post; 157: fourth hole; 158: first joint; 159: spring clip; 160: release sleeve; 161: light guide portion; 162: base; 163: first light bead; 164: support frame; 165: first frame body; 166: second frame body; 167: first annular portion; 168: second annular portion; 169: receiving portion; 170: first recess portion; 171: second guide groove; 172: positioning groove; 173: third boss; 174: fifth hole; 175: fourth boss; 176: positioning pin; 177: third positioning hole; 178: restriction surface; 179: bearing; 180: first positioning post; 181: fourth positioning hole; 182: first reinforcement portion; 183: fifth boss; 184: fifth positioning hole; 185: sixth boss; 186: second positioning post; 187: second reinforcement portion.

DETAILED DESCRIPTION

Embodiments will be described in detail below, and examples of the embodiments are shown in the accompanying drawings, where the same or similar reference numerals throughout denote the same or similar elements or elements having the same or similar functions. The following embodiments described with reference to the accompanying drawings are exemplary and serve merely to explain the embodiments, and should not be construed as limiting the embodiments.

In the description of various embodiments, it is to be understood that, the orientation or positional relationships indicated by the terms such as upper, lower, front, rear, left, right are based on the orientation or positional relationships shown in the accompanying drawings, merely to facilitate description of the embodiments and simplify the description, rather than indicating or implying that the device or element referred to must have a specific orientation and be constructed and operated in a specific orientation, which, therefore, cannot be construed as limiting the embodiments.

In the description of various embodiments, several refers to one or more; multiple refers to two or more; greater than, less than, over and the like are understood not to include the specified number, while above, below, within and the like are understood to include the specified number. If described, first and second are merely for the purpose of distinguishing technical features, and not to be construed as indicating or implying relative importance or implicitly indicating the number of technical features indicated or implicitly indicating the precedence relationship of technical features indicated.

In the description of various embodiments, unless explicitly defined otherwise, disposing, mounting, connecting and other words should be understood broadly, and a person of ordinary skill in the art can reasonably determine the specific meaning of the above words in various embodiments combined with the specific content of the technical solution.

A toy ball according to various embodiments will be described below with reference to FIGS. 1 to 19.

Figure 2:
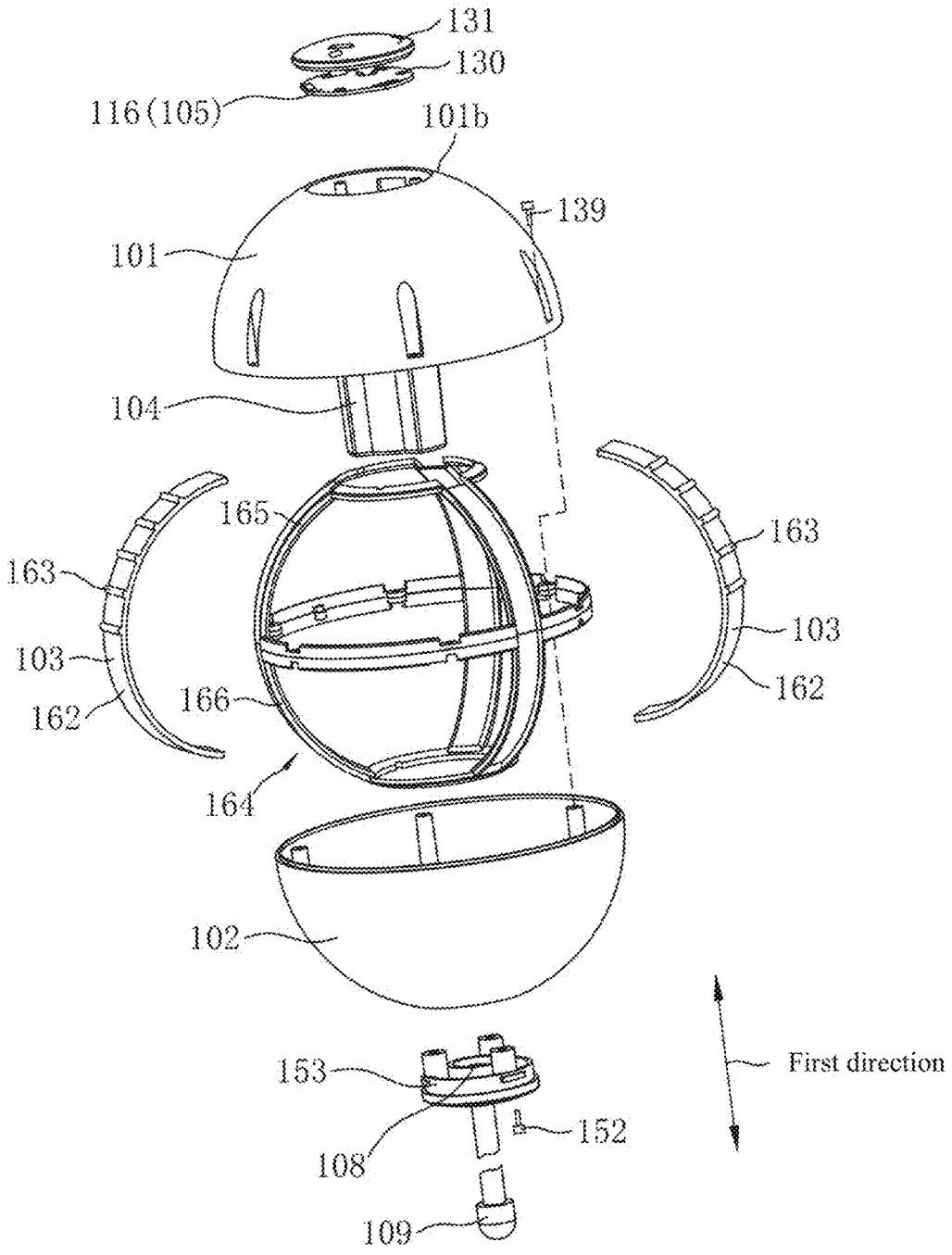
FIG. 2 is an exploded view of the toy ball in FIG. 1.
Figure 3:
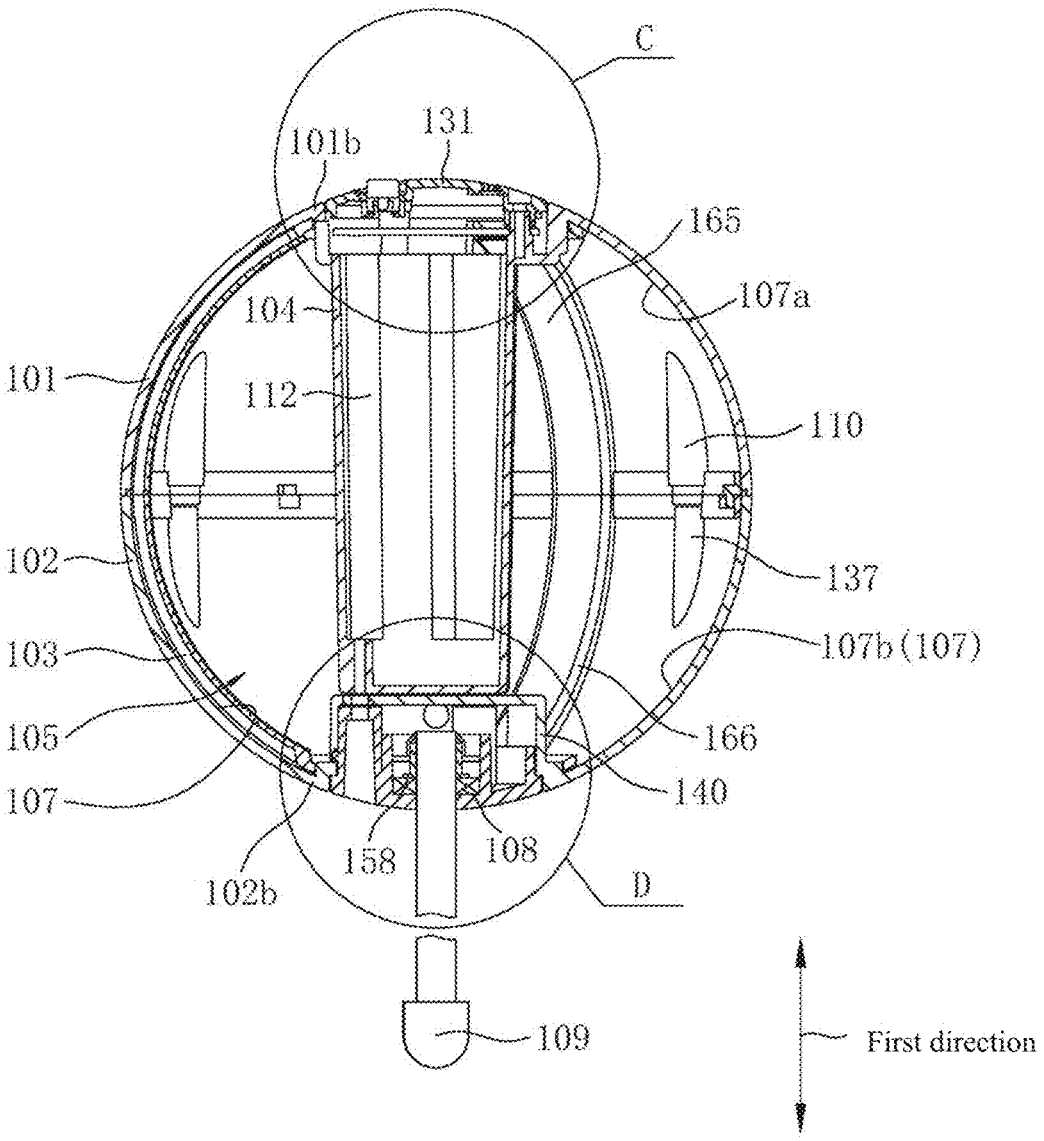
FIG. 3 is a cross-sectional view taken along a line A-A in FIG. 1.

FIG. 1 is a schematic view of a toy ball in an embodiment. FIG. 2 is an exploded view of the toy ball in FIG. 1. FIG. 3 is a cross-sectional view taken along a line A-A in FIG. 1. Referring to FIGS. 1 to 3, the toy ball in the embodiment includes a first shell 101 and a second shell 102, a plurality of first light-emitting elements 103, a first mounting base 104, and a control device 105. The first shell 101 and the second shell 102 are fitted with each other to form a cavity 106 inside. The plurality of first light-emitting elements 103 are spaced apart in the cavity 106 in a circumferential direction at the ends of the first shell 101 and the second shell 102 where they are fitted with each other. The first mounting base 104 is accommodated in the cavity 106. The control device 105 is mounted on the first mounting base 104 and is electrically connected to the first light-emitting elements 103.

The toy ball in the embodiment can present richer lighting effects. Specifically, in the existing technology, the main body of the toy ball is usually an integrated structure formed by, for example, 3D printing, and then a hole is opened in the main body to accommodate the control device 105 having a circuit board 116 and a battery (not shown in the figures) in the main body. In this structure, light beads are directly carried on the circuit board 116, and the range of the toy ball that the light emitted by the light beads can illuminate is very limited, presenting very limited lighting effect. In the embodiment, the first light-emitting elements 103 can be easily arranged inside the cavity 106 by using the first shell 101 and the second shell 102 that are fitted with each other to form the cavity 106, and the plurality of first light-emitting elements 103 can transmit light more uniformly in the cavity 106 by making the plurality of light-emitting elements 103 spaced apart in the circumferential direction at the ends of the first shell 101 and the second shell 102 where they are fitted with each other. Therefore, the toy ball of the embodiment can transmit light uniformly from multiple directions in the cavity 106, thereby making the overall lighting effect of the toy ball richer.

The toy ball in the embodiment can be used as a juggling ball, a swing ball, etc., but it is not limited thereto, and players can use the toy ball in various occasions according to their own preferences. In addition, when used as a swing ball, the toy ball is formed with a rope mounting portion 108 for mounting a rope 109 extending outward.

The first shell 101 and the second shell 102 are substantially hemispherical shells in appearance, and are injection-molded from elastic plastic materials such as polycarbonate (PC) or polyethylene (PE). The first shell 101 and the second shell 102 are substantially hollow. The end (sometimes also referred to as "first end 101*a*" for ease of distinction) of the first shell 101 and the end (sometimes also referred to as "second end 102*a*" for ease of distinction) of the second shell 102 are each circular in shape when viewed from above. When the first shell 101 and the second shell 102 are fitted with each other, they form a spherical appearance. The first end 101*a* of the first shell 101 and the second end 102*a* of the second shell 102 abut with each other for fitting. In addition, in the following description, for ease of explanation, the direction parallel (for example, perpendicular to the plane formed by the first end 101*a* of the first shell 101 or perpendicular to the plane formed by the second end 102*a* of the second shell 102) to the direction in which the first shell 101 and the second shell 102 are fitted with each other is called the first direction.

Figure 4:
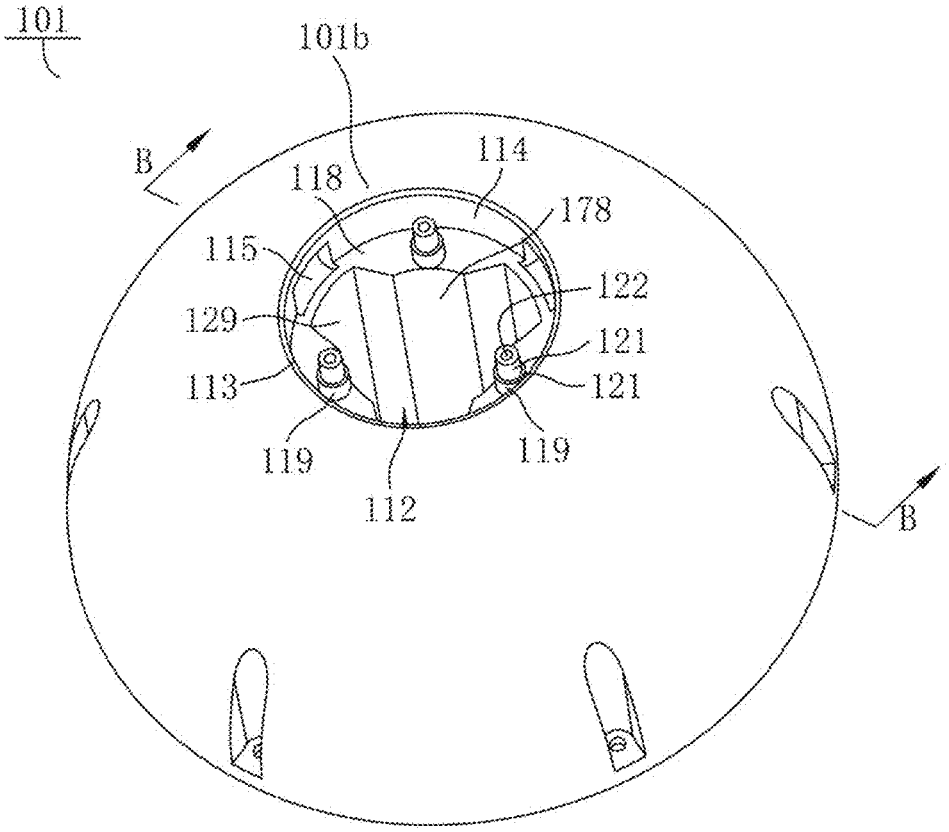
FIG. 4 is a schematic view of a first shell in FIG. 1 viewed from the bottom.
Figure 5:
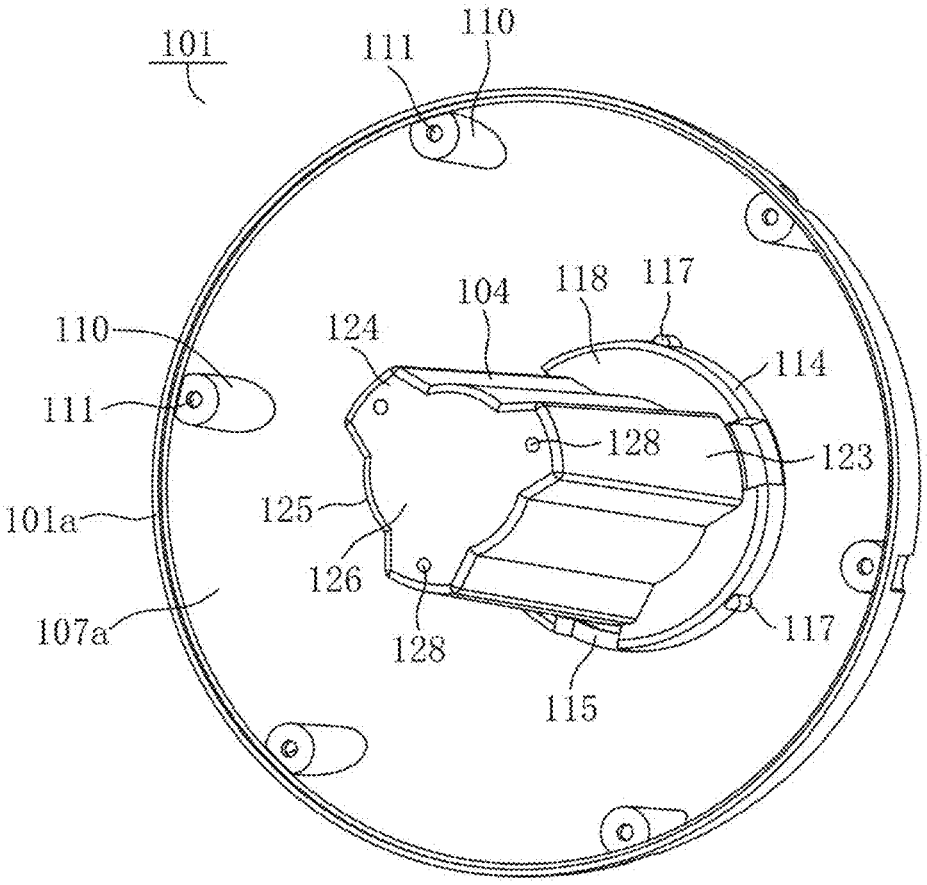
FIG. 5 is a schematic view of the first shell in FIG. 1 viewed from the inside.
Figure 6:
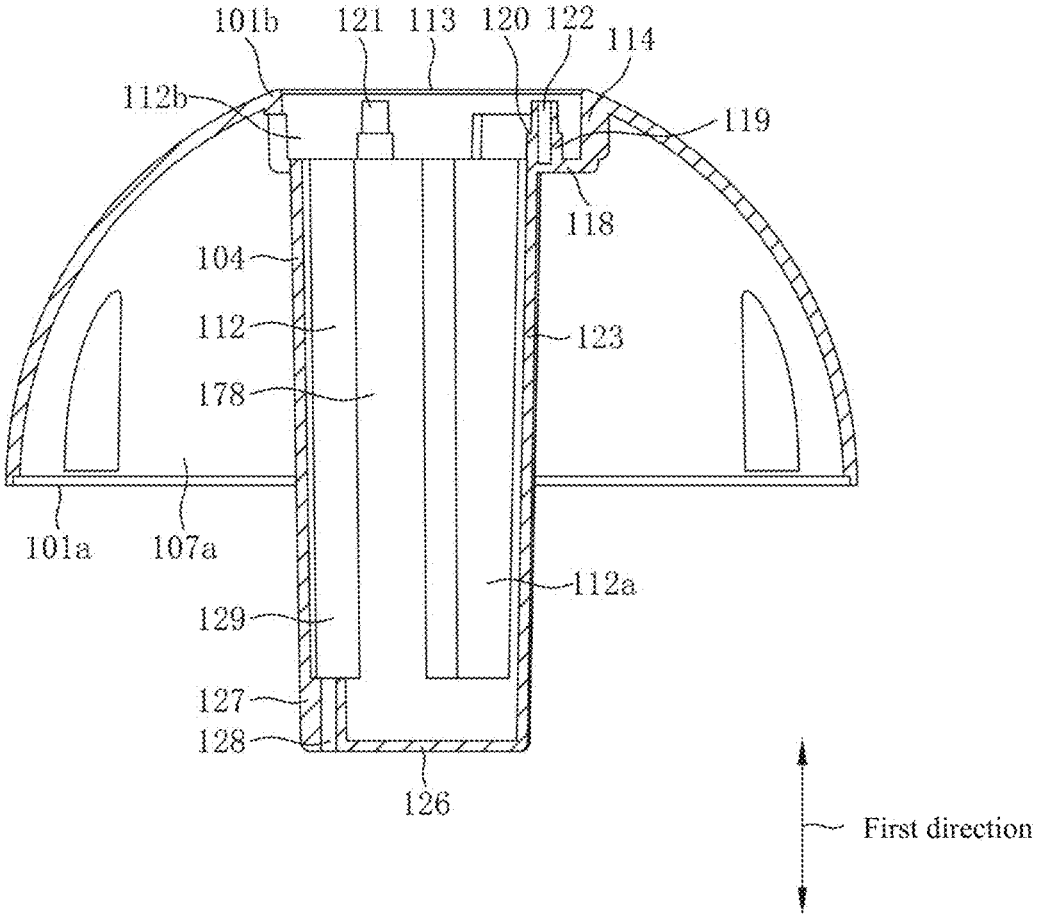
FIG. 6 is a cross-sectional view taken along a line B-B in FIG. 4.
Figure 7:
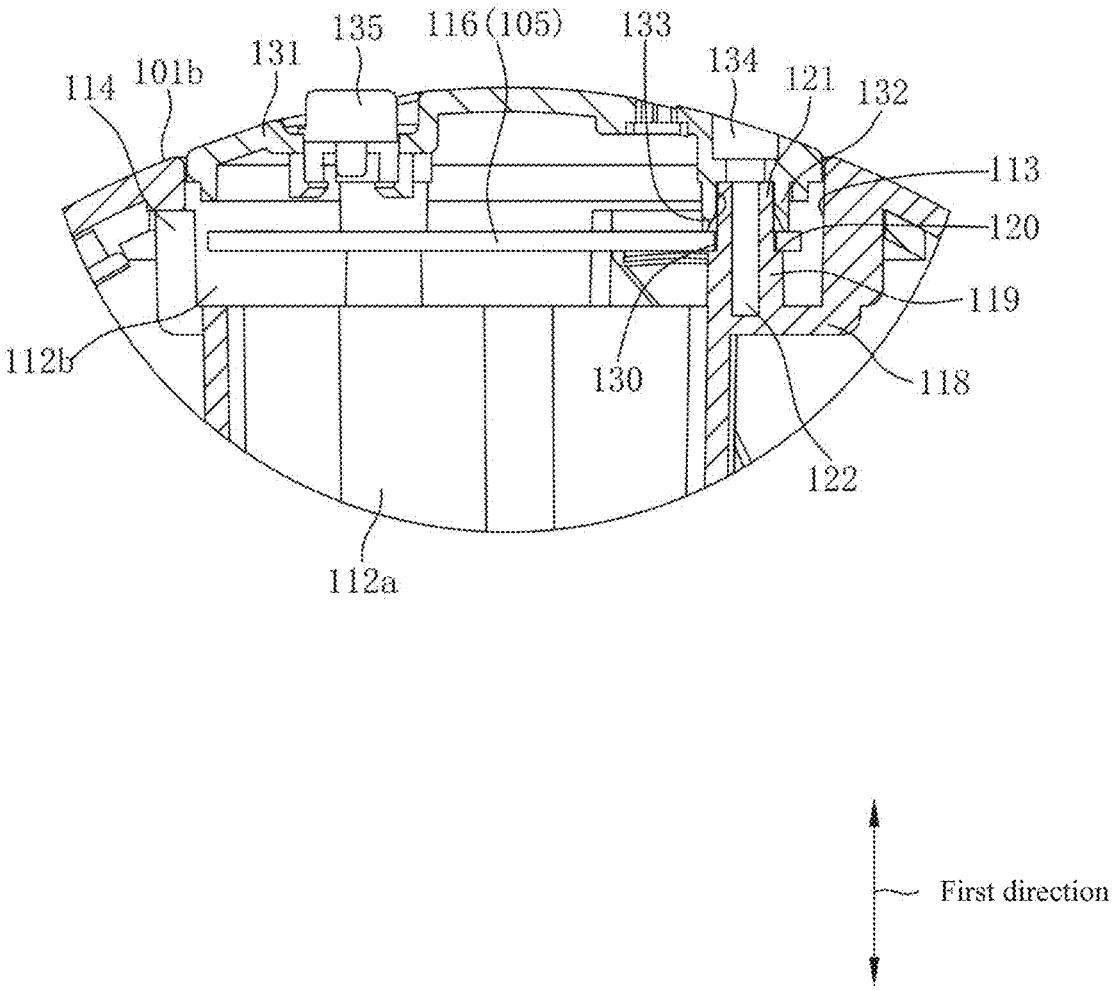
FIG. 7 is a partially enlarged view of portion C in FIG. 3.

FIG. 4 is a schematic view of the first shell 101 in FIG. 1 viewed from the bottom. FIG. 5 is a schematic view of the first shell 101 in FIG. 1 viewed from the inside. FIG. 6 is a cross-sectional view taken along a line B-B in FIG. 4. FIG. 7 is a partially enlarged view of portion C in FIG. 3. Referring to FIGS. 4 to 7, and continuing to refer to FIGS. 2 and 3, a plurality of first bosses 110 are formed on the inner wall surface 107 (sometimes also referred to as "first inner wall surface 107*a*" for ease of distinction) of the first shell 101, and the first bosses 110 are evenly distributed in the circumferential direction of the first end 101*a* of the first shell 101. First holes 111 are formed in the respective first bosses 110, and the first holes 111 extend through the first bosses 110 in a direction parallel to the first direction. Thus, the first holes 111 connect the outside and the inside of the first shell 101. The first holes 111 may be, for example, counterbores for threaded connection.

Referring mainly to FIGS. 5 and 6, the first mounting base 104 is integrally formed with the first shell 101 and extends from the first bottom 101*b* of the first shell 101 in the first direction. The first mounting base 104 defines a first mounting cavity 112 in the cavity 106. The first mounting cavity 112 has a first mounting hole 113 open to the outside of the first shell 101. The first mounting hole 113 is formed in the first bottom 101*b* of the first shell 101. The first mounting base 104 extends from the first bottom 101*b* of the first shell 101 toward the inner side of the first shell 101 in a direction parallel to the first direction. The first mounting base 104 is generally cylindrical.

The first mounting base 104 has a first side wall 114 that extends from the bottom (sometimes also referred to as "first bottom 101*b*" for ease of illustration) of the first shell 101 toward the inner side of the first shell 101 in the first direction. The first side wall 114 has a substantially circular annular cross-section. A plurality of first notches 115 are formed in the first side wall 114 in the circumferential direction which extend through the first side wall 114. Although the first notches 115 are designed to facilitate mold release when the first shell 101 is formed by injection molding, the cavity 106 of the toy ball (the inner side of the first shell 101) and the first mounting cavity 112 can be connected through the first notches 115, thereby facilitating the connection of wires (also referred to as "first wires" for ease of illustration, not shown in the figures) between the first light-emitting elements 103 and the circuit board 116. A plurality of first protrusions 117 are formed on the outer side of the first side wall 114, that is, on the side opposite to the first inner wall surface 107*a*, and the plurality of first protrusions 117 are evenly spaced in the circumferential direction of the first side wall 114. The first protrusions 117 extend in a direction parallel to the first direction.

The first mounting base 104 has a middle wall 118 that is formed at a distal end of the first side wall 114 and extends from the distal end of the first side wall 114 toward the middle portion of the first shell 101 in a direction parallel to the plane formed by the first end 101*a* of the first shell 101. A plurality of first mounting posts 119 protruding toward the first mounting hole 113 in a direction parallel to the first direction are formed on the middle wall 118. The first mounting posts 119 are in a stepped shape, and have support surfaces 120 and positioning portions 121 protruding from the support surfaces 120 toward the first mounting hole 113. In addition, a first threaded hole 122 is formed on each of the first mounting posts 119. The first threaded holes 122 extend from the distal ends of the respective positioning portions 121 toward one side of the middle wall 118 in the direction parallel to the first direction. The method for forming the first threaded holes 122 is not particularly limited. For example, the first threaded holes 122 may be formed by insert molding (embedding a nut) when the first shell 101 is injection-molded. Alternatively, the first threaded holes 122 may also be formed by tapping. Similarly, other threaded holes described below (such as second threaded holes 128 and third threaded holes 138 described later) can also be formed by, for example, insert molding or tapping, which will not be described again here.

The first mounting base 104 has a second side wall 123. The radial dimension of the outer circumference of the second side wall 123 is less than the radial dimension of the outer circumference of the first side wall 114. One end of the second side wall 123 is connected to the middle edge of the middle wall 118, and the other end of the second side wall 123 extends toward the inner side of the first shell 101 in the first direction and protrudes from the first end 101*a* of the first shell 101. The second side wall 123 has a substantially triangular annular cross-section, that is, the second side wall 123 has three corner portions 124 and arc portions 125 respectively located between two adjacent corner portions 124.

The first mounting base 104 has a first distal bottom 126 that is substantially parallel to the plane formed by the first end 101*a* of the first shell 101. The first distal bottom 126 is connected to the other end of the second side wall 123 and seals the other end of the first side wall 114. The first distal bottom 126 is formed with thickened portions 127 at positions corresponding to the corner portions 124 of the second side wall 123 in the direction parallel to the first direction. The first distal bottom 126 is thicker at the thickened portions 127, for example, the thickness in the first direction is greater than 5 mm. The first distal bottom 126 is formed with a plurality of second threaded holes 128 at the thickened portions 127, and the plurality of second threaded holes 128 are evenly distributed in the circumferential direction of the first distal bottom 126.

Continuing to refer to FIGS. 6 and 7, the battery and the circuit board 116 are mounted in the first mounting cavity 112 through the first mounting hole 113. Specifically, the first mounting cavity 112 includes a battery mounting cavity 112*a* defined by the second side wall 123 and the first distal bottom 126, and a circuit board mounting cavity 112*b* defined by the first side wall 114 and the middle wall 118. The arc portions 125 of the second side wall 123 are formed with a plurality of restriction surfaces 178 facing the battery mounting cavity 112*a*. When the battery is loaded in the battery mounting cavity 112*a*, the plurality of restriction surfaces 178 jointly limit the radial swing of the battery. The battery may be a well-known cylindrical battery such as a No. 7 battery (AAA battery) or a No. 5 battery (AA battery). A positive terminal (not shown in the figures) and a negative terminal (not shown in the figures) of the battery are mounted in the battery mounting cavity 112*a*. The positive terminal may be mounted on one side of the battery mounting cavity 112*a* located at the first distal bottom 126, and the negative terminal may be mounted on one side of the battery mounting cavity 112*a* close to the circuit board mounting cavity 112*b*. When the battery is loaded in the battery mounting cavity 112*a*, the positive terminal and the negative terminal restrict the axial movement of the battery.

Each of the corner portions 124 of the second side wall 123 is formed with a storage groove 129 facing the battery mounting cavity 112*a*, and the wires connecting the circuit board 116 and the positive terminal and the negative terminal are stored in the storage groove 129. In addition, the storage groove 129 may be filled with a buffer member (not shown in the figures) such as sponge. When the battery is loaded in the battery mounting cavity 112*a*, the buffer member wraps the battery to prevent the battery from loosening. The circuit board 116 may be, for example, a rigid PCB board. A plurality of first positioning holes 130 are formed in the circuit board 116. When the circuit board 116 is mounted in the circuit board mounting cavity 112*b*, the circuit board 116 is supported on the support surfaces 120 of the first mounting posts 119, and the positioning portions 121 of the first mounting posts 119 pass through the respective first positioning holes 130 of the circuit board 116, thereby positioning the circuit board 116.

Figure 8:
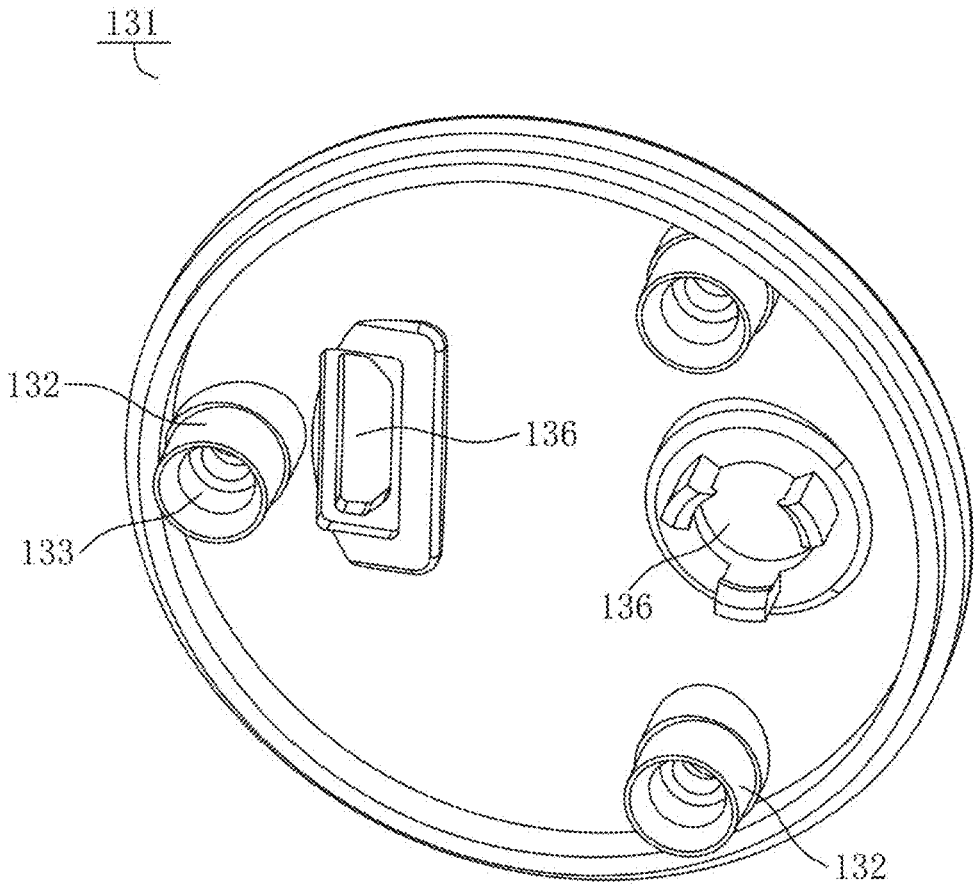
FIG. 8 is a schematic view of a first cover in FIG. 1.

FIG. 8 is a schematic view of a first cover 131 in FIG. 1. Referring to FIG. 8, and with auxiliary reference to FIGS. 1, 2, and 7, the toy ball further includes a first cover 131. The first cover 131 covers the first mounting cavity 112, that is, the first cover 131 covers the first mounting cavity 112 through the first mounting hole 113. In addition, the first cover 131 is detachable relative to the first mounting hole 113. The outer side of the first cover 131 has an arc shape. When the first cover 131 covers the first mounting cavity 112, the outer arc surface of the first cover 131 and the outer arc surface of the first shell 101 together form a spherical arc surface.

A plurality of second mounting posts 132 are formed on the inner side (that is, the side facing the first mounting hole 113) of the first cover 131. The second mounting posts 132 are formed to extend toward the middle wall 118 of the first mounting base 104 in the first direction. In addition, When the first cover 131 covers the first mounting cavity 112, the second mounting posts 132 and the first mounting post 119 are respectively arranged opposite to each other in the first direction. The second mounting posts 132 are each formed with second positioning holes 133, and the diameter of the second positioning holes 133 is substantially the same as the diameter of the first positioning holes 130. In addition, a plurality of second holes 134 (for example, counterbores for mounting screws) are formed in the first cover 131. The second holes 134 respectively correspond to the second mounting posts 132, and respectively extend through the outer side of the first cover 131 and are respectively connected coaxially to the second positioning holes 133 formed in the second mounting posts 132.

When the first cover 131 covers the first mounting cavity 112, the positioning portions 121 of the first mounting posts 119 are inserted into the respective second positioning holes 133, thereby restricting the rotation of the first cover 131 relative to the first mounting hole 113. In addition, the second holes 134 are aligned and connected with the first threaded holes 122 formed at the distal ends of the second mounting posts 132. When screws, for example, pass through the respective second holes 134 and are secured to the respective first threaded holes 122, the distal ends of the second mounting posts 132 abut against and reliably press the circuit board 116 onto the support surfaces 120 of the first mounting posts 119. Therefore, while the first cover 131 covers the first mounting cavity 112, the second mounting posts 132 formed on the first cover 131 and the first mounting posts 119 formed on the first shell 101 together clamp the circuit board 116.

The circuit board 116 has a control button 135 for controlling on or off of the first light-emitting elements 103, and a charging interface (not shown in the figures) for charging the battery. The type of the control button 135 is not particularly limited, and the control button 135, for example, may be a general cylindrical control button mounted on the rigid circuit board 116. The type of the charging interface is also not particularly limited, and the charging interface, for example, may be a Type-c interface or a Micro-USB interface. Correspondingly, the first cover 131 is formed with avoidance portions 136 that allows the control button 135 and the charging port to be operated. The structures of the avoidance portions 136 are not particularly limited, and the avoidance portions 136, for example, may be avoidance grooves that are adaptively opened according to the shapes, positions or the like of the control button 135 and the charging interface.

Figure 9:
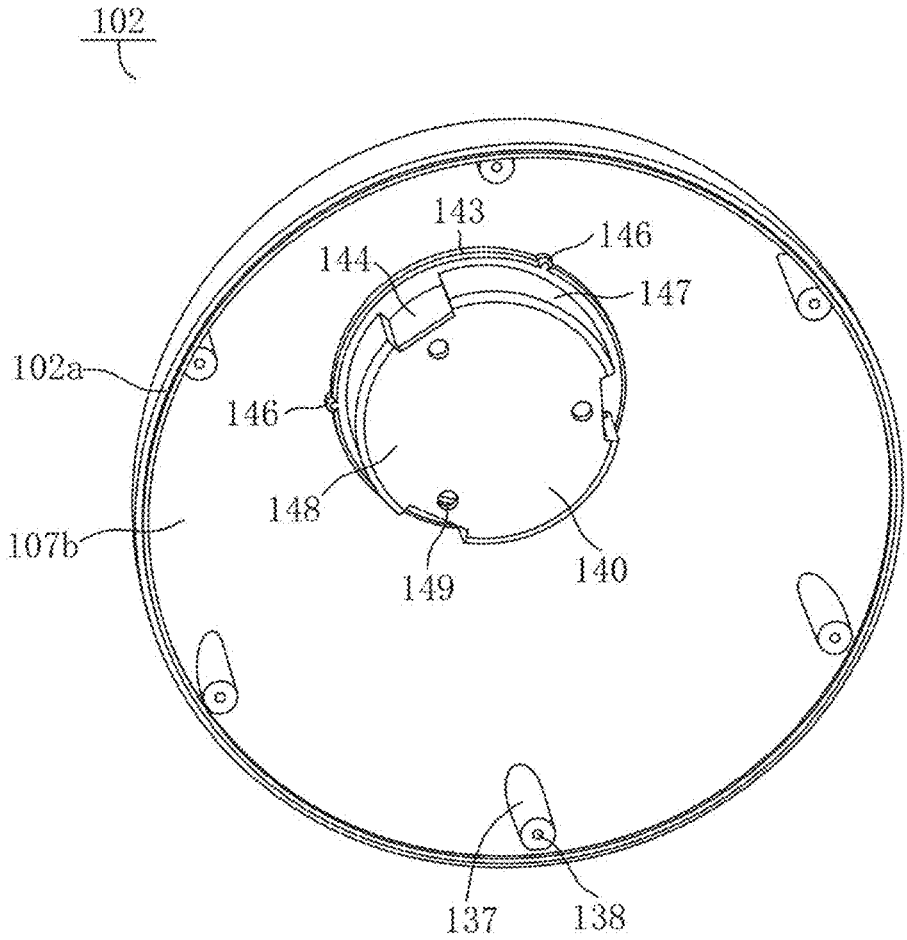
FIG. 9 is a schematic view of a second shell in FIG. 1 viewed from the inside.
Figure 10:
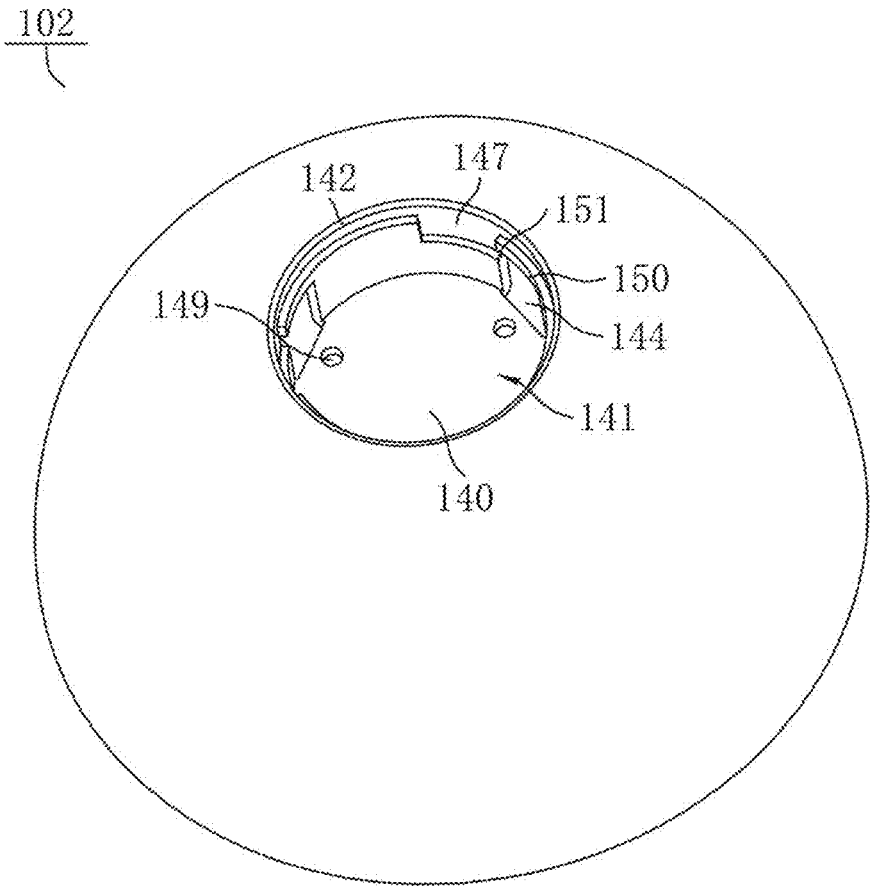
FIG. 10 is a schematic view of the second shell in FIG. 1 viewed from the bottom.
Figure 11:
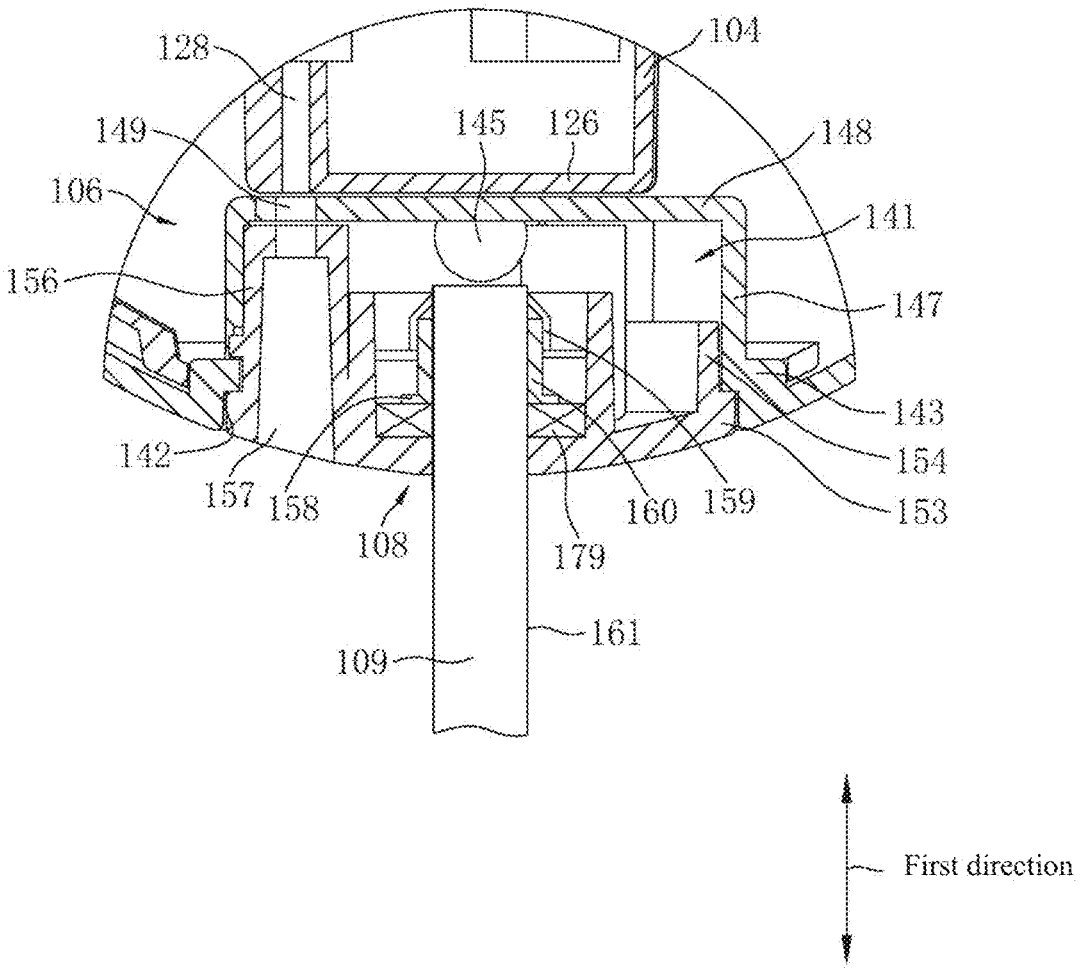
FIG. 11 is a partially enlarged view of portion D in FIG. 3.

FIG. 9 is a schematic view of a second shell 102 in FIG. 1 viewed from the inside. FIG. 10 is a schematic view of the second shell 102 in FIG. 1 viewed from the bottom. FIG. 11 is a partially enlarged view of portion D in FIG. 3. Referring to FIGS. 9 to 11, and with auxiliary reference to FIG. 3, a plurality of second bosses 137 are formed on the inner wall surface 107 (sometimes also referred to as "second inner wall surface 107*b*" for ease of distinction) of the second shell 102. The second bosses 137 are evenly distributed in the circumferential direction of the second end 102*a* of the second shell 102. Third threaded holes 138 are formed in the respective second bosses 137, and the third threaded holes 138 extend from the distal ends of the second bosses 137 toward the second inner wall surface 107*b* in the first direction.

When the first shell 101 and the second shell 102 are fitted with each other, the first end 101*a* of the first shell 101 and the second end 102*a* of the second shell 102 are aligned with each other, and the first holes 111 formed in the first bosses 110 of the first shell 101 and the third threaded holes 138 formed in the second bosses 137 of the second shell 102 face each other. Then, first locking elements 139 such as screws pass through the first holes 111, and the screws as the first locking elements 139 are secured to the third threaded holes 138, so that the first shell 101 and the second shell 102 can be secured with each other to form the toy ball.

The second shell 102 is integrally formed with a second mounting base 140 that defines a second mounting cavity 141 in the cavity 106, and the second mounting cavity 141 has a second mounting hole 142 open toward the outside of the second shell 102. Specifically, the second mounting hole 142 is formed at the bottom (sometimes also referred to as second bottom 102*b* for ease of distinction) of the second shell 102, and the second mounting base 140 extends from the second bottom 102*b* of the second shell 102 toward the inner side of the second shell 102 in the first direction. The second mounting base 140 is generally cylindrical.

The second mounting base 140 has a third side wall 143 extending from the second bottom 102*b* of the second shell 102 toward the inner side of the second shell 102 in the first direction. The third side wall 143 has a substantially circular annular cross section and is formed with a plurality of second notches 144 in the circumferential direction which extend through the third side wall 143. Although the second notches 144 are designed to facilitate mold release when the second shell 102 is formed by injection molding, the cavity 106 of the toy ball (the inner side of the second shell 102) and the second mounting cavity 141 can be connected through the second notches 144, thereby facilitating the wire connection between the second light-emitting element 145 (described later) and the circuit board 116.

A plurality of second protrusions 146 are formed on the outer side of the third side wall 143, that is, on the side opposite to the second inner wall surface 107*b*, and the plurality of second protrusions 146 are evenly spaced in the circumferential direction of the third side wall 143. The second protrusions 146 extend outside the third side wall 143 in the first direction. The second mounting base 140 has a fourth side wall 147. The radial dimension of the outer circumference of the fourth side wall 147 is less than the radial dimension of the outer circumference of the third side wall 143. One end of the fourth side wall 147 is connected to the distal end (that is, the end away from the second bottom 102*b* of the second shell 102) of the third side wall 143, and the other end of the fourth side wall 147 extends toward the second end 102*a* of the second shell 102 in the first direction. The second mounting base 140 has a second distal bottom 148 that is substantially parallel to the plane formed by the second end 102*a* of the second shell 102. The second distal bottom 148 is connected to and seals the other end of the fourth side wall 147. The second distal bottom 148 is formed with a plurality of third holes 149 that are evenly distributed in the circumferential direction of the second distal bottom 148 and extend through the second distal bottom 148.

In addition, the second mounting base 140 is formed with a plurality of first blocking portions 150 on the side facing the second mounting cavity 141. The first blocking portions 150 protrude from the inner surface (that is, the surface facing the second mounting cavity 141) of the fourth side wall 147 toward the middle portion of the second mounting cavity 141, and are located on the sides of the second notches 144 adjacent to the second mounting hole 142 in the first direction. A first guide groove 151 is formed between each of the first blocking portions 150 and the inner surface of the fourth side wall 147. One end of the first guide groove 151 is open toward the second mounting hole 142. In addition, the first guide groove 151 is connected with the respective second notch 144.

When the first shell 101 and the second shell 102 are fitted with each other, the second mounting base 140 and the first mounting base 104 are aligned with each other in the first direction in the cavity 106, and the outer surface of the second distal bottom 148 of the second mounting base 140 is attached to the outer surface of the first distal bottom 126 of the first mounting base 104. However, considering processing errors or the like, during the design stage, a gap, for example, greater than 0 mm and less than 0.5 mm is provided between the outer surface of the second distal bottom 148 of the second mounting base 140 and the outer surface of the first distal bottom 126 of the first mounting base 104 in the first direction, thereby ensuring that the first shell 101 and the second shell 102 can be completely fitted with each other.

When the first shell 101 and the second shell 102 are fitted with each other and the first holes 111 of the first bosses 110 of the first shell 101 are aligned with the respective third threaded holes 138 of the second bosses 137 of the second shell 102, the plurality of third holes 149 formed in the second distal bottom 148 and the plurality of second threaded holes 128 formed in the first distal bottom 126 are aligned with each other in a direction parallel to the first direction. Thus, second locking elements 152 (described later) such as screws pass through the respective third holes 149, and the screws as the second locking elements 152 are secured to the respective second threaded holes 128, so that the first shell 101 and the second shell 102 can be secured to each other from the middle of the toy ball.

Figure 12:
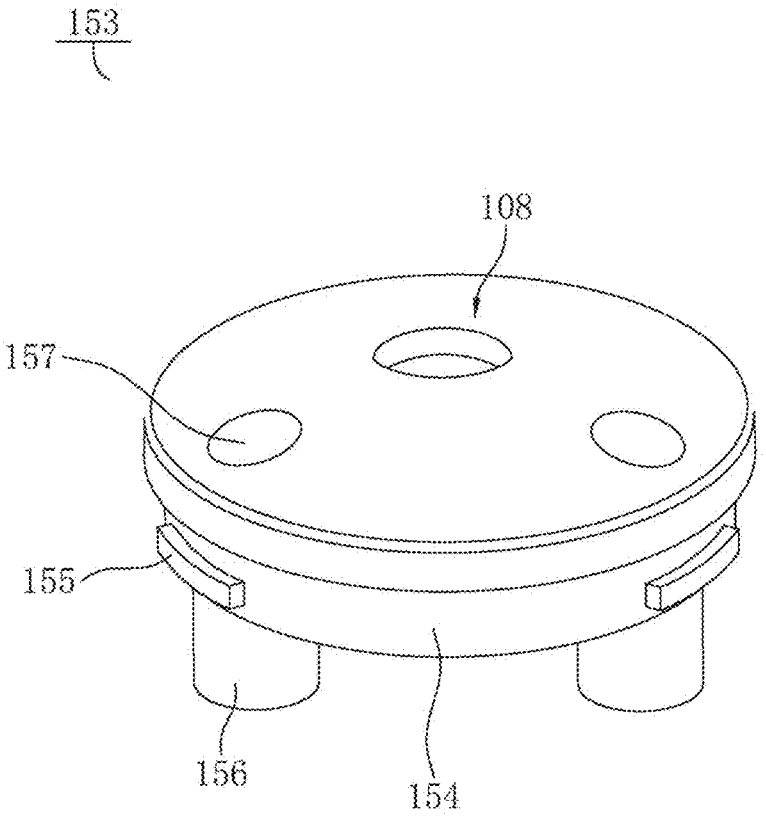
FIG. 12 is a schematic view of a second cover in FIG. 2.

FIG. 12 is a schematic view of a second cover 153 in FIG. 2. Referring to FIG. 12, and with auxiliary reference to FIGS. 11 and 2, the toy ball further includes a second cover 153. The second cover 153 covers the second mounting cavity 141, that is, the second cover 153 covers the second mounting cavity 141 by covering the second mounting hole 142. In addition, the second cover 153 is detachable relative to the second mounting hole 142. The second cover 153 is made of a plastic material with strong rigidity. The outer side of the second cover 153 has an arc shape. When the second cover 153 covers the second mounting cavity 141, the outer arc surface of the second cover 153 and the outer arc surface of the second shell 102 together form a spherical arc surface.

An annular fifth side wall 154 is formed on the inner side (that is, the side facing the second mounting hole 142) of the second cover 153. The radial dimension of the outer circumference of the fifth side wall 154 is less than the radial dimension of the second mounting hole 142. A plurality of second blocking portions 155 are formed on the outer circumference of the fifth side wall 154, and the second blocking portions 155 protrude outward relative to the fifth side wall 154 in the radial direction. The plurality of second blocking portions 155 are evenly distributed in the circumferential direction of the fifth side wall 154.

When the second cover 153 is mounted in the second mounting hole 142, the second cover 153 is arranged in the second mounting hole 142 by aligning the second blocking portions 155 with the respective first guide grooves 151 of the second mounting base 140 of the second shell 102. At this point, the second blocking portions 155 slides in the respective first guide grooves 151. When the second blocking portions 155 slide to the sides of the first guide grooves 151 that are connected to the second notches 144, the second cover 153 is rotated, and the second blocking portions 155 slide from the first guide grooves 151 to the positions of the second notches 144. At this point, the second cover 153 moves in the first direction and is blocked by the first blocking portions 150, which can thus prevent the second cover 153 from falling off relative to the first cover 131.

A plurality of third mounting posts 156 are formed on the inner side (that is, the side facing the second mounting hole 142) of the second cover 153. The third mounting posts 156 are evenly distributed in the circumferential direction of the second cover 153, and are formed to extend toward the second distal bottom 148 of the second mounting base 140 in the first direction when the second cover 153 covers the second mounting cavity 141. When the second cover 153 covers the second mounting cavity 141, the distal ends of the third mounting posts 156 abut against or are close to the second distal bottom 148.

A plurality of fourth holes 157 (for example, counterbores for mounting screws) are formed in the second cover 153. The fourth holes 157 extend through the second cover 153 coaxially with the third mounting posts 156 from the outer side of the second cover 153. When the second cover 153 covers the second mounting cavity 141 and the first holes 111 of the first bosses 110 of the first shell 101 are aligned with the respective third threaded holes 138 of the second bosses 137 of the second shell 102, the fourth holes 157 are respectively aligned in the first direction with to the third holes 149 formed in the second distal bottom 148. More specifically, the fourth holes 157 formed in the second cover 153, the third holes 149 formed in the second distal bottom 148 of the second shell 102 and the second threaded holes 128 formed in the first distal bottom 126 of the first shell 101 are aligned in a direction parallel to the first direction. Therefore, the second locking elements 152 such as screws that pass through the fourth holes 157 and the third holes 149 sequentially from the outer side of the toy ball can be secured to the second threaded holes 128, so that the first shell 101 and the second shell 102 are secured to each other from a direction of the toy ball parallel to the first direction while securing the second cover 153.

As described above, when used as a swing ball, the toy ball is formed with a rope mounting portion 108 for mounting a rope 109 extending outward. In a specific embodiment, the rope mounting portion 108 of a swing ball as the toy ball is formed on the second cover 153, and the rope 109 is mounted on the rope mounting portion 108. Specifically, the rope mounting portion 108 includes a first joint 158 disposed in the middle of the second cover 153. For example, the first joint 158 is disposed on the second cover 153 in a manner of being rotatable in the circumferential direction relative to the second cover 153 but being restricted in the axial direction. The manner and structure in which the first joint 158 is rotatably disposed on the second cover 153 are not particularly limited. For example, a ratchet structure (not shown in the figures) or a snapping structure (not shown in the figures) may be disposed on the first joint 158, thereby removably securing the first joint 158 on the second cover 153. The first joint 158 may be a straight-through joint used to connect a pluggable air tube in a pneumatic system. As a typical structure of such straight-through joint, there are a spring clip 159 and a release sleeve 160 inside the joint. When an air tube is inserted into the straight-through joint, the spring clip 159 clamps the air tube, thereby preventing the air tube from being pulled out. When the air tube needs to be pulled out, the release sleeve 160 is pressed to disengage the spring clip 159 from the air tube, so that the air tube can be pulled out. In addition, the rope mounting portion 108 further includes a bearing 179. The bearing 179 and the first joint 158 are coaxially disposed in the middle of the second cover 153, and the bearing 179 is located on the outer side relative to the first joint 158. The bearing 179 is disposed on the second cover 153 by, for example, insert molding.

The rope 109 is, for example, a rope 109 made of a soft material such as polyurethane (PU), thermoplastic polyurethane elastomer rubber (TPU). In addition, the rope 109 may be a commercially available rope. The rope 109 is, for example, a solid rope, and a wall of the rope 109 serves as the light guide portion 161. In the case of using a straight joint as the first joint 158, when one end of the rope 109 passes through the bearing 179 and is inserted into the first joint 158, one end of the rope 109 is clamped by the spring clip 159 of the first joint 158, thereby securing the rope 109 to the first joint 158 of the rope mounting portion 108 of the second cover 153. It is to be noted that one end of the rope 109 may also extend beyond the first joint 158 by a section, allowing for knotting at the end of the rope 109 to prevent the rope 109 from detaching from the first joint 158 in case the spring clip 159 of the first joint 158 fails.

Continuing to refer to FIG. 11, a second light-emitting element 145 is mounted in the second mounting cavity 141, and the second light-emitting element 145 faces the light guide portion 161 at the end of the rope 109. More specifically, the second light-emitting element 145 may for example, include light beads, and may be attached to the middle portion of the second distal bottom 148 of the second mounting base 140. The light beads as the second light-emitting element 145 face the light guide portion 161 of the rope 109.

Continuing to refer to FIGS. 2 and 3, as mentioned above, the plurality of first light-emitting elements 103 are spaced apart in the cavity 106 in a circumferential direction at the ends of the first shell 101 and the second shell 102 where they are fitted with each other, and are secured. Specifically, when the first shell 101 and the second shell 102 are fitted with each other, the inner wall surface 107 (that is, the first inner wall surface 107*a*) of the first shell 101 and the inner wall surface 107 (that is, the second inner wall surface 107*b*) of the second shell 102 together form a substantially spherical inner wall surface 107 in the cavity 106 of the toy ball. The first light-emitting elements 103 extend from a position close to the first bottom 101*b* of the first shell 101 along the first inner wall surface 107*a* of the first shell 101 and the second inner wall surface 107*b* of the second shell 102 to a position close to the second bottom 102*b* of the second shell 102. Therefore, the first light-emitting elements 103 can emit light across the entire cavity 106 of the toy ball.

Each of the first light-emitting elements 103 has a base 162 and a plurality of light beads (sometimes also referred to as "first light beads 163" for ease of distinction) carried on the base 162. The first light-emitting elements 103 may be, for example, LED light strips. In a case of using LED light strips as the first light-emitting elements 103, the base 162 may be, for example, strip-shaped FPC (flexible circuit board), and the first light beads 163 are carried on the FPC. The base 162 of each of the first light-emitting elements 103 extend along the inner wall surface 107 of the toy ball from one end of the cavity 106 in the first direction, that is, the first bottom 101*b* of the first shell 101, toward the other end of the cavity 106 in the first direction, that is, the second bottom 102*b* of the second shell 102, and the first light beads 163 are fixed in the cavity 106, facing the inner wall surface 107.

Figure 13:
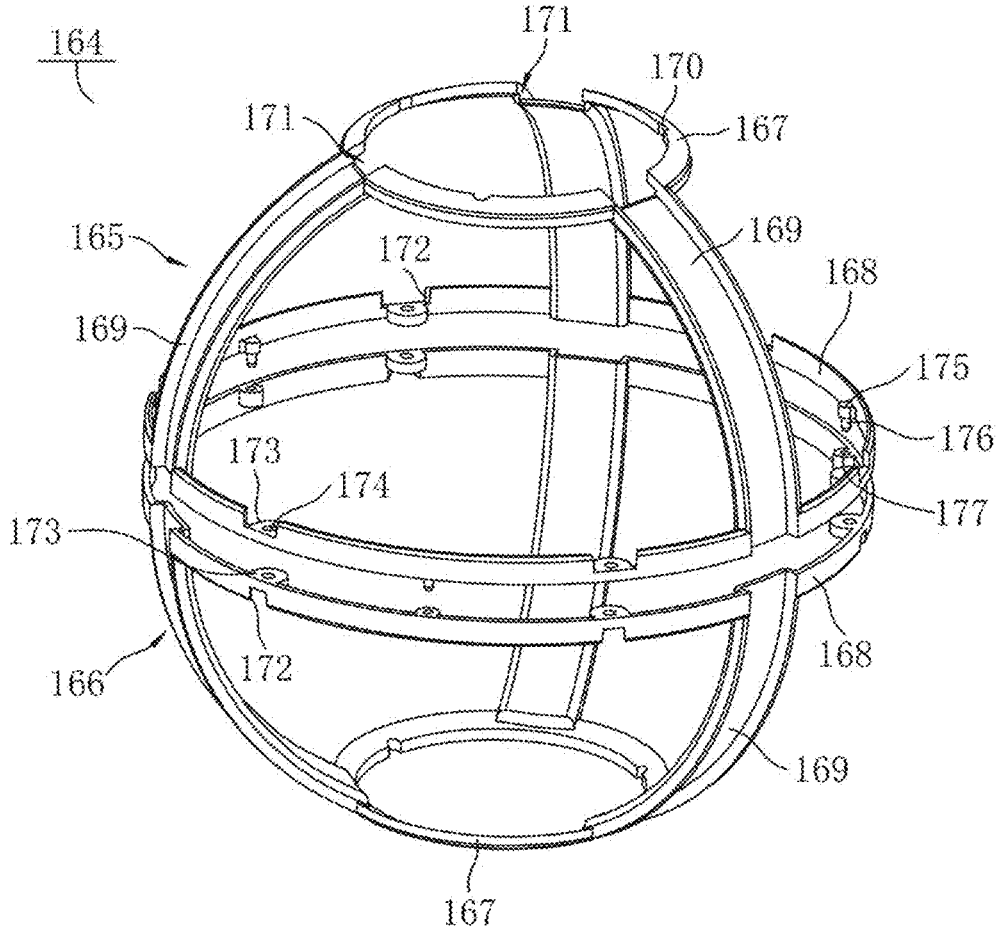
FIG. 13 is a schematic view of a support frame in FIG. 2.
Figure 14:
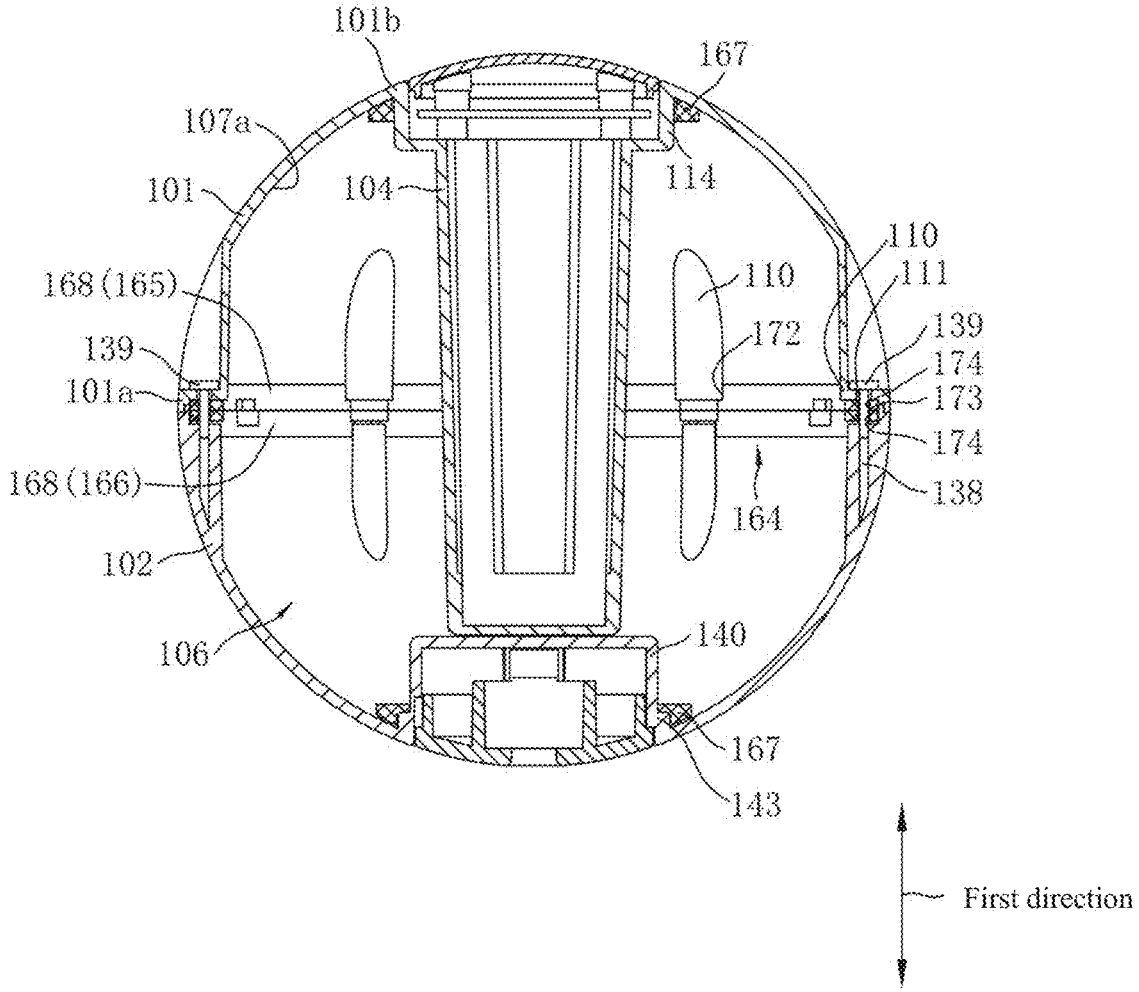
FIG. 14 is a cross-sectional view taken along a line E-E in FIG. 1.

FIG. 13 is a schematic view of a support frame 164 in FIG. 2. FIG. 14 is a cross-sectional view taken along a line E-E in FIG. 1. In addition, it is to be noted that FIG. 14 mainly shows the assembly state of the first shell 101, the second shell 102, and the support frame 164, and the illustration of some unrelated assembly relationships may be omitted.

Referring to FIGS. 13, 14, and 2, the toy ball further includes a support frame 164 disposed in the cavity 106. The first light-emitting elements 103 may be attached and fixed to the support frame 164 through adhesives such as tapes. Alternatively, the first light-emitting elements 103 may also be secured to the support frame 164 through locking elements such as screws, or the first light-emitting elements 103 may also be fixed to the support frame 164 through clamping elements such as buckles.

When the first shell 101 and the second shell 102 are fitted with each other, the support frame 164 not only supports the first light-emitting elements 103 in the cavity 106, but also supports the first shell 101 and the second shell 102. More specifically, in a specific embodiment, the first shell 101, the second shell 102, and the support frame 164 are secured together through the first locking elements 139 to support the first shell 101 and the second shell 102. In other words, the support frame 164 is reliably mounted in the cavity 106 through the first locking elements 139, thereby suppressing the shaking of the support frame 164 and the first light-emitting elements 103 when the toy ball is swung. Furthermore, the support frame 164 prevents the first shell 101 and the second shell 102 from collapsing inward.

The support frame 164 includes a first frame body 165 and a second frame body 166. The first frame body 165 and the second frame body 166 are engaged with or separated from each other. In a mounted state, the first frame body 165 is accommodated in the first shell 101, the second frame body 166 is accommodated in the second shell 102, and the position where the first frame body 165 and the second frame body 166 are engaged with each other is substantially the same as the position where the first shell 101 and the second shell 102 are fitted with each other, so that the first shell 101, the second shell 102 and the support frame 164 can be secured together through the first locking elements 139. The structures of the first frame body 165 and the second frame body 166 are substantially the same, therefore the first frame body 165 will be mainly described here, and the second frame body 166 will be mentioned when necessary. In addition, for ease of illustration, the same features of the first frame body 165 and the second frame body 166 are given the same names and the same reference numerals.

The first frame body 165 includes a first annular portion 167, a second annular portion 168, and a plurality of receiving portions 169 connecting the first annular portion 167 and the second annular portion 168. The first frame body 165 is, for example, a component integrally formed by injection molding or 3D printing using an elastic plastic material such as polycarbonate (PC) or polyethylene (PE).

The first annular portion 167 is substantially annular-shaped, and the inner diameter of the first annular portion 167 is substantially the same as the diameter of the outer circumference of the first side wall 114. A plurality of first recess portions 170 are formed evenly in the circumferential direction on the inner side of the first annular portion 167. In the mounted state, one end of the support frame 164 is clamped on the first mounting base 104. More specifically, the first annular portion 167 of the first frame body 165 of the support frame 164 is arranged around the first side wall 114 of the first mounting base 104 at the first bottom 101*b* of the first shell 101. Moreover, the first protrusions 117 are respectively clamped into the first recess portions 170. Thus, one end of the support frame 164 can be reliably fixed to the first mounting base 104 formed on the first shell 101. A plurality of second guide grooves 171 are formed in the first annular portion 167 in the circumferential direction. The first annular portions 167 are each connected to the respective receiving portions 169 at the positions of the second guide grooves 171. In the mounted state, each of the second guide grooves 171 of the first annular portion 167 and each of the first notches 115 of the first side wall 114 are circumferentially opposite to each other.

The receiving portions 169 have an arc shape as a whole, and the cross sections of the receiving portions 169 are generally U-shaped. The receiving portions 169 are used to receive the first light-emitting elements 103, that is, the bases 162 of the first light-emitting elements 103 can be, for example, attached to the receiving portions 169 through adhesive tapes. For example, wires, and the like used to electrically connect the first light-emitting elements 103 and the circuit board 116 extend from the first mounting cavity 112 to the cavity 106 (the inner side of the first shell 101) of the toy ball via the first notches 115 and the second guide grooves 171.

In the mounted state, the open ends of the receiving portions 169 face the inner side of the first shell 101, and the radius of the arcs at the open ends of the receiving portions 169 is approximately the same as the radius of the first inner wall surface 107*a* of the first shell 101, or the radius of the arcs at the open ends of the receiving portions 169 is slightly greater than the radius of the first inner wall surface 107*a* of the first shell 101, so that in the mounted state, the receiving portions 169 abut against the first inner wall surface 107*a* of the first shell 101 and can support the first shell 101. In addition, the receiving portions 169 extend from substantially the first bottom 101*b* of the first shell 101 along the first inner wall surface 107*a* of the first shell 101 to substantially the first end 101*a* of the first shell 101. The number of the receiving portions 169 is not particularly limited and is configured according to the number of the first light-emitting elements 103. For example, in some specific embodiments, there are three first light-emitting elements 103. Correspondingly, there are also three receiving portions 169 evenly arranged in the circumferential direction of the first frame body 165.

The second annular portion 168 is substantially annular-shaped, and the outer diameter of the second annular portion 168 is approximately the same as the inner diameter of the first end 101*a* of the first shell 101. In the mounted state, the second annular portion 168 abuts against the first end 101*a* of the first shell 101. The second annular portion 168 has a plurality of positioning grooves 172 evenly formed in the circumferential direction on the side facing the first annular portion 167. The number of the positioning grooves 172 is not particularly limited, and may be, for example, determined according to the number of the first bosses 110 of the first shell 101.

In the mounted state, the first bosses 110 of the first shell 101 are respectively fitted in the positioning grooves 172 of the first frame body 165. A plurality of third bosses 173 are formed evenly on the inner side of the second annular portion 168 in the circumferential direction. The third bosses 173 and the positioning grooves 172 are adjacent to each other in the axial direction of the first frame body 165. The number of the third bosses 173 is not particularly limited, and may be determined, for example, according to the number of the first bosses 110 of the first shell 101. Each of the third bosses 173 is formed with a fifth hole 174 extending therethrough in the axial direction. In the mounted state, the third bosses 173 of the first frame 165 are substantially aligned with the first bosses 110 of the first shell 101 respectively in a direction parallel to the first direction. In addition, the fifth holes 174 are substantially coaxial with the respective first holes 111 formed in the first bosses 110. A plurality of fourth bosses 175 are also evenly formed on the inner side of the second annular portion 168 in the circumferential direction. The fourth bosses 175 and the third bosses 173 are misaligned with each other in the circumferential direction of the first frame body 165. Positioning pins 176 extending in the first direction are formed on the respective fourth bosses 175.

As mentioned above, the structures of the second frame body 166 and the first frame body 165 are substantially the same, that is, the second frame body 166 also includes a first annular portion 167, a second annular portion 168, and a plurality of receiving portions 169 connecting the first annular portion 167 and the second annular portion 168. The main difference between the second frame body 166 and the first frame body 165 is that the second frame body 166 is formed with third positioning holes 177 extending therethrough in the axial direction at positions corresponding to the fourth bosses 175 of the first frame body 165. The second frame body 166 and the first frame body 165 are engaged with each other by the positioning pins 176 formed on the first frame body 165 being inserted into the third positioning holes 177 formed in the fourth bosses 175 of the second frame body 166. When the first frame body 165 and the second frame body 166 are engaged with each other, the first annular portion 167 of the first frame body 165 and the first annular portion 167 of the second frame body 166 are arranged opposite to each other in the first direction, and the receiving portions 169 of the first frame body 165 and the receiving portions 169 of the second frame body 166 are smoothly connected. The second annular portion 168 of the first frame body 165 and the second annular portion 168 of the second frame body 166 are connected with each other.

Therefore, through the engagement of the first frame body 165 and the second frame body 166, the support frame 164 is in the shape of a rugby ball as a whole, that is, the rugby ball-shaped support frame 164 respectively includes, in the long axis direction, two first annular portions 167 at both ends, a second annular portion 168 located in the middle (in a case where the second annular portion 168 of the first frame body 165 and the second annular portion 168 of the second frame body 166 are engaged with each other, the two second annular portions 168 can be regarded as one second annular portion 168), and a plurality of receiving portions 169 connecting the two first annular portions 167 and the second annular portion 168. When being mounted to the first shell 101 and the second shell 102, the two first annular portions 167 of the support frame 164 are respectively clamped in the first mounting base 104 of the first shell 101 and the second mounting base 140 of the second shell 102. The receiving portions 169 of the support frame 164 extend from the first bottom 101*b* of the first shell 101 along the inner wall surface 107 of the cavity 106 to the second bottom 102*b* of the second shell 102. The second annular portion 168 of the support frame 164 respectively abuts against the first end 101*a* of the first shell 101 and the second end 102*a* of the second shell 102 in the cavity 106.

Continuing to refer to FIGS. 2, 13, and 14, the following is an exemplary illustration of the mounting of the first shell 101, the second shell 102, and the support frame 164.

First, the positioning pins 176 of the first frame body 165 are inserted into the third positioning holes 177 of the second frame body 166 to form the support frame 164. In this state, the fifth holes 174 of the third bosses 173 of the first frame body 165 and the fifth holes 174 of the third bosses 173 of the second frame body 166 are aligned with each other.

Then, the bases 162 of the LED light strips as the first light-emitting elements 103 are attached to the receiving portions 169 of the first frame body 165 and the receiving portions 169 of the second frame body 166 of the support frame 164. In this state, the bases 162 extend, in the extension direction of the receiving portions 169, from the ends of the receiving portions 169 of the second frame body 166 close to the first annular portion 167 of the second frame body 166 to one end of the first frame body 165 close to the first annular portion 167 of the first frame body 165.

Next, the first annular portion 167 of the first frame body 165 of the support frame 164 is arranged around the first side wall 114 of the first mounting base 104 at the first bottom 101*b* of the first shell 101, and the first protrusions 117 are respectively clamped into the first recess portions 170 of the first annular portion 167 of the first frame body 165, so that one end of the support frame 164 is clamped in the first mounting base 104. At the same time, the positioning grooves 172 formed in the first frame body 165 of the support frame 164 are clamped into the first bosses 110 formed on the first shell 101, thereby completing the positioning of the support frame 164 relative to the first shell 101.

In addition, it is to be noted that while positioning the support frame 164 and the first shell 101, the wires connecting the circuit board 116 and the first light-emitting elements 103 and the second light-emitting element 145 are stored in the receiving portions 169 of the support frame 164 via the first notches 115 and the second guide grooves 171. Thereby, these wires can be reliably stored and can be suppressed from being significantly shaken or entangled with the swing of the toy ball.

Then, the third side wall 143 of the second mounting base 140 of the second shell 102 is arranged around the first annular portion 167 of the second frame body 166 of the support frame 164, and the second protrusions 146 of the third side wall 143 are respectively clamped into the first recess portions 170 of the first annular portion 167 of the second frame body 166, so that the other end of the support frame 164 is clamped at the second mounting base 140. At the same time, the positioning grooves 172 formed in the second frame body 166 of the support frame 164 are clamped to the second bosses 137 formed on the second shell 102, thereby completing the positioning of the support frame 164 relative to the second shell 102.

Next, the first shell 101 and the second shell 102 are finely adjusted to make the first holes 111 formed in the first bosses 110 of the first shell 101, the fifth holes 174 formed in third bosses 173 of the first frame body 165 and the second frame body 166 of the support frame 164, and the third threaded holes 138 formed in the second bosses 137 of the second shell 102 are aligned in the first direction.

Then, the first locking elements 139 such as screws pass through the first holes 111 and the screws are secured to the third threaded holes 138, so that the first shell 101, the second annular portion 168 of the support frame 164, and the second shell 102 can be secured with each other, thereby forming the structure of the main body of the toy ball.

The following is an exemplary illustration of the mounting of other structures of the toy ball.

Referring to FIG. 7, and with auxiliary reference to FIGS. 2 and 3, after the structure of the main body of the toy ball is mounted, the first cover 131 is aligned with the first mounting hole 113, and the second mounting posts 132 of the first cover 131 are aligned with the first mounting posts 119 formed on the middle wall 118 of the first mounting base 104 of the first shell 101. Moreover, the avoidance portions 136 of the first cover 131 are aligned with the control button 135, the charging interface of the circuit board 116.

Then, for example, screws pass through the second holes 134 that are formed in the first cover 131 and pass through the second mounting posts 132 to be secured to the first threaded holes 122 formed in the first mounting posts 119, thereby securing the first cover 131. At the same time, the circuit board 116 is clamped by the second mounting posts 132 and the first mounting posts 119 cooperatively.

Referring to FIG. 11, and with auxiliary reference to FIGS. 2 and 3, the second cover 153 is then aligned with the second mounting hole 142, and the fourth holes 157 formed in the second cover 153 are aligned with the third holes 149 formed in the second distal bottom 148 of the second shell 102.

Then, from the outer side of the toy ball, the screws as the second locking elements 152 pass through the fourth holes 157 and the third holes 149 in sequence, and are secured to the second threaded holes 128 formed in the first distal bottom 126 of the first mounting base 104 of the first shell 101. Thus, while securing the second cover 153, the first mounting base 104 of the first shell 101 and the second mounting base 140 of the second shell 102 are secured to each other in the direction of the toy ball parallel to the first direction.

Finally, one end of the rope 109 passes through the bearing 179 disposed on the second cover 153 and is inserted into the first joint 158. Thus, the assembly of the toy ball as a swing ball is completed.

In addition, it is to be noted that when the toy ball is, for example, the juggling ball, since there is no need to use the rope 109, the assembly does not include the above steps of assembling the rope 109.

Referring mainly to FIGS. 2 and 3, in the toy ball of an embodiment, the cavity 106 is formed by using the first shell 101 and the second shell 102 that are fitted with each other, so that the first light-emitting elements 103 can be easily disposed in the cavity 106. The plurality of first light-emitting elements 103 are spaced apart in the circumferential direction at the ends of the first shell 101 and the second shell 102 where they are fitted with each other, so that light of the plurality of first light-emitting elements 103 is transmitted more uniformly in the cavity 106. Therefore, the toy ball of the embodiment can transmit light uniformly from multiple directions in the cavity 106, thereby making the overall lighting effect of the toy ball richer.

In addition, in the toy ball of an embodiment, the support frame 164 is disposed in the cavity 106 of the toy ball, and the support frame 164 is secured together with the first shell 101 and the second shell 102, so that the weight of the toy ball can be reduced while maintaining its shape. For example, in order to maintain the shape of conventional toy balls that are integrally formed by 3D molding, other holding structures are integrally formed inside, which results in a heavy weight and may cause pain when hitting others while swinging. In the toy ball of the embodiment, the first shell 101 and the second shell 102 have a spherical shape when they are fitted with each other. In addition, since the first shell 101 and the second shell 102 have a hollow shell shape as a whole, the weight can be reduced. Further, since the support frame 164 is disposed in the cavity and the support frame 164 is secured together with the first shell and the second shell, the support frame 164 can maintain the shapes of the first shell 101 and the second shell 102 to a certain extent while supporting the first light-emitting elements 103. Therefore, the toy ball of the embodiment can reduce weight while maintaining its shape.

Further, in the toy ball of an embodiment, by mounting the support frame 164 in the cavity 106 of the toy ball, the support frame 164 supports the first light-emitting elements 103 and allows the first light beads 163 of the first light-emitting elements 103 to face the inner wall surface 107 of the cavity 106, which allows the first light beads 163 to transmit light outward and can improve the brightness of the toy ball, thereby further enriching the overall lighting effect of the toy ball.

Referring mainly to FIG. 14, in the toy ball of an embodiment, by securing the support frame 164 together with the first shell 101 and the second shell 102, the mounting reliability of the middle portion of the support frame 164 in the first direction can be improved, thereby suppressing shaking of the first light-emitting elements 103 mounted on the support frame 164. Further, by clamping one end of the support frame 164 onto the first mounting base 104 of the first shell 101 and the other end onto the second mounting base 140 of the second shell 102, the reliability of the mounting of the support frame 164 at both ends in the first direction can be improved, thereby further suppressing shaking of both ends of the first light-emitting elements 103 mounted on the support frame 164. Thus, the wire at one end of each of the first light-emitting elements 103 is prevented from shaking or even loosening. In addition, wires connected to the second light-emitting element 145 via the support frame 164 and the second notches 144 of the second mounting base 140 are suppressed from shaking or even loosening. Thus, the stability for the circuit of the toy ball can be improved.

Referring mainly to FIG. 13, in the toy ball of an embodiment, the support frame 164 has first annular portions 167, a second annular portion 168, and a plurality of receiving portions 169 connecting the first annular portions 167 and the second annular portion 168, so that the overall support strength of the support frame 164 can be improved. When the support frame 164 is mounted in the cavity 106 of the toy ball, the receiving portions 169 of the support frame 164 extend from the first bottom 101*b* of the first shell 101 to the second bottom 102*b* of the second shell 102 along the inner wall surface 107 of the cavity 106, and the second annular portion 168 of the support frame 164 respectively abuts against the first end 101*a* of the first shell 101 and the second end 102*a* of the second shell 102, so that while supporting the first light-emitting elements 103 reliably, the entire support frame 164 can also serve as a reinforcement structure for the first shell 101 and the second shell 102, so as to prevent the walls of the first shell 101 and the second shell 102 from collapsing, and to suppress the first end 101*a* of the first shell 101 and the second end 102*a* of the second shell 102 from being broken due to collision at the position where they are fitted with each other.

Although the first mounting base 104 is integrally formed on the first shell 101 and the second mounting base 140 is integrally formed on the second shell 102, the overall masses of the first shell 101 and the second shell 102 are relatively light. By using the support frame 164 as the reinforcement structure for the first shell 101 and the second shell 102, it is possible to reduce the overall weight of the toy ball while suppressing the collapsing of the walls of the first shell 101 and the second shell 102, making it easier for operators to use.

Referring mainly to FIGS. 13 and 5, in addition, in the toy ball of an embodiment, the first recess portions 170 are respectively formed in the first annular portions 167 at both ends of the support frame 164, the first protrusions 117 clamped in the first recess portions 170 are formed on the outer circumference of the first side wall 114 of the first mounting base 104, and the second protrusions 146 clamped in the first recess portions 170 are formed on the third side wall 143 of the second mounting base 140, so that the positioning accuracy of the support frame 164 relative to the first shell 101 and the second shell 102 is improved. In addition, by forming the positioning grooves 172 in the second annular portion 168 of the support frame 164 for positioning the first bosses 110 of the first shell 101 and the second bosses 137 of the second shell 102, the positioning accuracy when the first shell 101, the second shell 102 and the support frame 164 are mounted with each other can be further improved, thereby reducing mounting difficulty.

Referring mainly to FIGS. 3, 6, 7, and 11, in the toy ball of an embodiment, the first mounting base 104 extending in the first direction is formed on the first shell 101 and the first mounting base 104 defines the first mounting cavity 112 in the cavity 106, so that the circuit board 116 and the battery can be reliably mounted. By forming the first mounting posts 119 on the first mounting base 104 and forming the second mounting posts 132 on the first cover 131, when the first cover 131 covers the first mounting cavity 112, the second mounting posts 132 and the first mounting posts 119 cooperatively position and clamp the circuit board 116, which can further reliably mount the circuit board 116 and prevent the circuit board 116 from shaking.

The second mounting base 140 extending in the first direction is formed on the second shell 102, and the second mounting base 140 defines the second mounting cavity 141 in the cavity 106, so that while being able to receive the end of the rope 109, the second light-emitting element 145 can be mounted in the second mounting cavity 141, and the second light-emitting element 145 can face the light guide portion 161 of the rope 109, thereby further enriching the overall lighting effect of the toy ball.

Referring mainly to FIGS. 3 and 11, further, when the first shell 101 and the second shell 102 are fitted with each other, the second mounting base 140 and the first mounting base 104 are aligned with each other in the cavity 106 in the first direction, and the outer surface of the second distal bottom 148 of the second mounting base 140 is attached to the outer surface of the first distal surface of the first mounting base 104. Moreover, the first mounting base 104 and the second mounting base 140 are secured by the second locking elements 152 while securing the second cover 153. In this way, the first shell 101 and the second shell 102 can be secured to each other from the middle portion of the toy ball in the first direction, which can further improve the securing stability of the toy ball, and prevent the toy ball from collapsing in the first direction.

Referring mainly to FIGS. 11 and 6, in the toy ball of an embodiment, thickened portions 127 are formed at the first distal bottom 126 of the first mounting base 104 of the first shell 101 and the second threaded holes 128 are formed at the thickened portions 127, and the second locking elements 152 for securing the second cover 153 to which the rope 109 is mounted are secured to the second threaded holes 128, so that the securing strength of the second cover 153 can be enhanced, and the second cover 153 and the second locking elements 152 can be prevented from falling off relative to the second shell 102 when the toy ball is swung.

Referring mainly to FIGS. 2 and 11, the rope 109 is mounted on the second cover 153 with stronger rigidity, so that the mounting strength of the rope 109 can be improved and the rope 109 can be prevented from falling off relative to the toy ball.

Referring mainly to FIGS. 2, 11, and 12, in the toy ball of an embodiment, the rope 109 can be easily mounted by mounting, for example, a straight joint as the first joint 158 to the second cover 153. Furthermore, since the rope 109 is rotatable in the circumferential direction relative to the second cover 153 through the bearing 179 and the first joint 158, it is possible to prevent the rope 109 from being entangled at the rope mounting portion 108 when the toy ball is swung, or prevent stress concentration from occurring on the rope mounting portion 108, causing damage to the rope mounting portion 108. Further, since the first joint 158 is rotatable in the circumferential direction relative to the second cover 153, the second light-emitting element 145 mounted in the second mounting cavity 141 and the light guide portion 161 of the rope 109 can always remain aligned with each other. Therefore, the light from the second light-emitting element 145 can be smoothly guided along the light guide portion 161 of the rope 109.

In the above embodiment, although the example in which a plurality of first bosses 110 are formed on the first inner wall surface 107*a* of the first shell 101 and the first holes 111 are formed in the first bosses 110 has been illustrated, it is not limited thereto.

Figure 15:
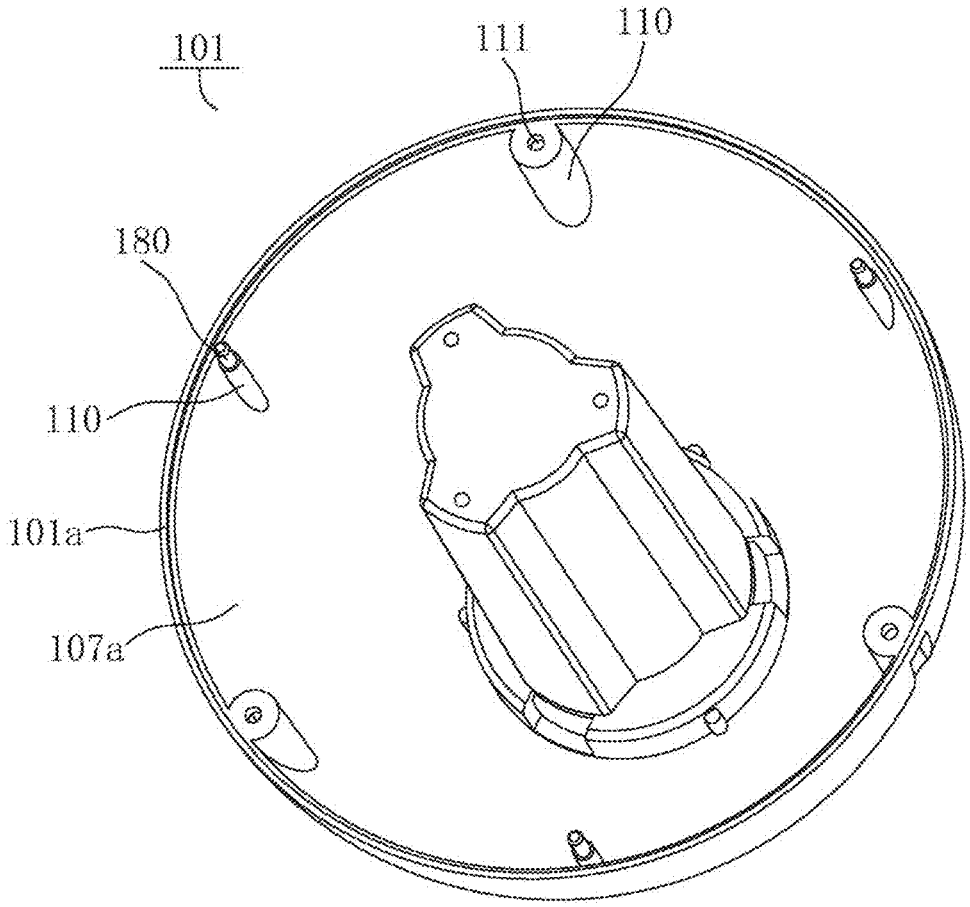
FIG. 15 is a schematic view of the first shell in another embodiment of the toy ball viewed from the inside.
Figure 16:
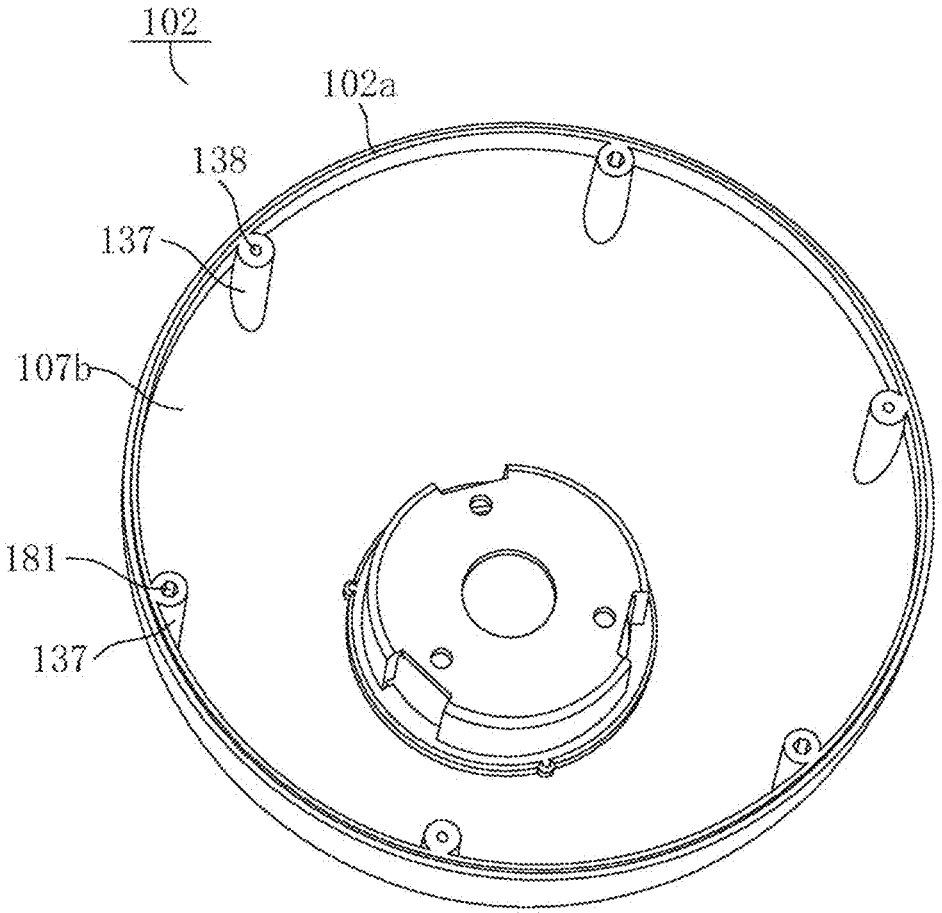
FIG. 16 is a schematic view of the second shell in another embodiment of the toy ball viewed from the inside.
Figure 17:
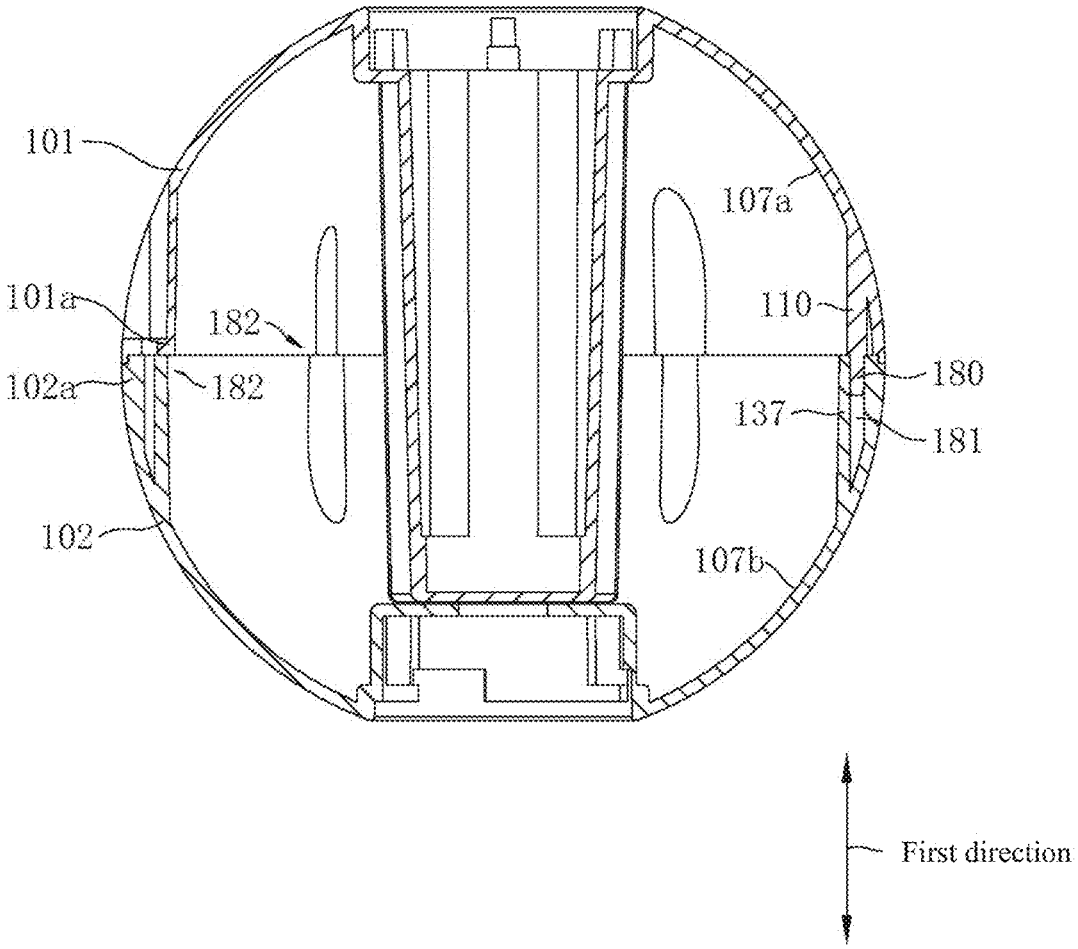
FIG. 17 is a schematic cross-sectional view of the first shell in FIG. 15 and the second shell in FIG. 16 when being fitted with each other.

FIG. 15 is a schematic view of the first shell 101 viewed from the inside. FIG. 16 is a schematic view of the second shell 102 viewed from the inside. Referring to FIGS. 15 and 16, it is also possible that the first holes 111 are formed in some of the first bosses 110, and the first positioning posts 180 that extend in a direction parallel to the first direction and protrude from the first end 101*a* are formed on the other of the first bosses 110. The first bosses 110 formed with the first holes 111 and the first bosses 110 formed with the first positioning posts 180 are alternately distributed in the circumferential direction along the first end 101*a*.

Correspondingly, among the plurality of second bosses 137 formed on the second inner wall surface 107*b* of the second shell 102, third threaded holes 138 are formed in some of the second bosses 137, and fourth positioning holes 181 are formed on the other of the second bosses 137, which extend from the distal ends of the respective second bosses 137 toward the second inner wall surface 107*b* in the first direction. The second bosses 137 formed with the third threaded holes 138 and the second bosses 137 formed with the fourth positioning holes 181 are alternately distributed along the second end 102*a* of the second shell 102.

Therefore, when the first shell 101 and the second shell 102 are fitted with each other, the first end 101*a* of the first shell 101 and the second end 102*a* of the second shell 102 are arranged opposite to each other, and the plurality of first positioning posts 180 formed in the first shell 101 are respectively inserted into the fourth positioning holes 181 formed in the second bosses 137 of the second shell 102, thereby completing the alignment between the first shell 101 and the second shell 102.

By disposing the first positioning posts 180 and the fourth positioning holes 181, the first shell 101 and the second shell 102 can be aligned more easily. In addition, when the first shell 101 and the second shell 102 are fitted with each other, the first bosses 110 and the second bosses 137 are arranged opposite to each other and can form a reinforcement portion (also referred to as "first reinforcement portion 182" for ease of distinction). Through this first reinforcement portion 182, the strength of the first end 101*a* of the first shell 101 and the second end 102*a* of the second shell 102 at the fitting position can be strengthened, and the first end 101*a* of the first shell 101 and the second end 102*a* of the second shell 102 can be prevented from collapsing inward.

In addition, in the above embodiment, although the example in which the first mounting base 104 and the first shell 101 are integrally formed has been illustrated, it is not limited thereto. The first mounting base 104 can also be an independent component, and is secured in the cavity 106 of the toy ball through, for example, screws.

In the above embodiment, although the example in which the toy ball has the support frame 164 has been illustrated, it is not limited thereto. The toy ball may not have the support frame 164. Instead, receiving grooves for receiving the first light-emitting elements 103 are formed in the inner wall surface 107 of the cavity 106, and the first light-emitting elements 103 are directly attached into the receiving grooves.

In the above embodiment, although the example in which the support frame 164 includes the first frame body 165 and the second frame body 166 has been illustrated, it is not limited thereto. For example, the support frame 164 can also be an integrally formed component, and in a case of being integrally formed, the support frame 164 also includes two first annular portions 167 located at both ends, a second annular portion 168 located in the middle, and a plurality of receiving portions 169 connecting the two first annular portions 167 and the second annular portion 168, respectively.

In the above embodiment, the example in which the support frame 164 has the second annular portion 168 has been illustrated, but it is not limited thereto. The support frame 164 may, for example, have the following form.

Figure 18:
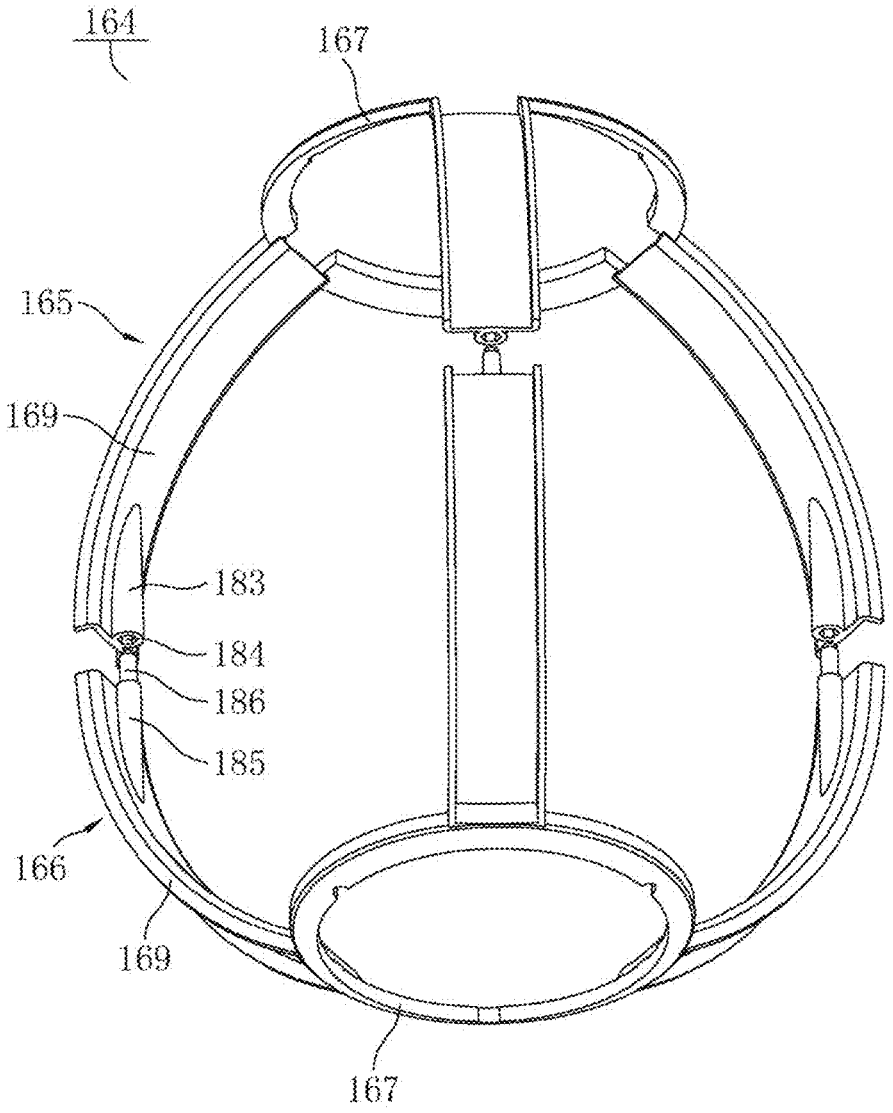
FIG. 18 is a schematic view of the support frame in another embodiment of the toy ball.
Figure 19:
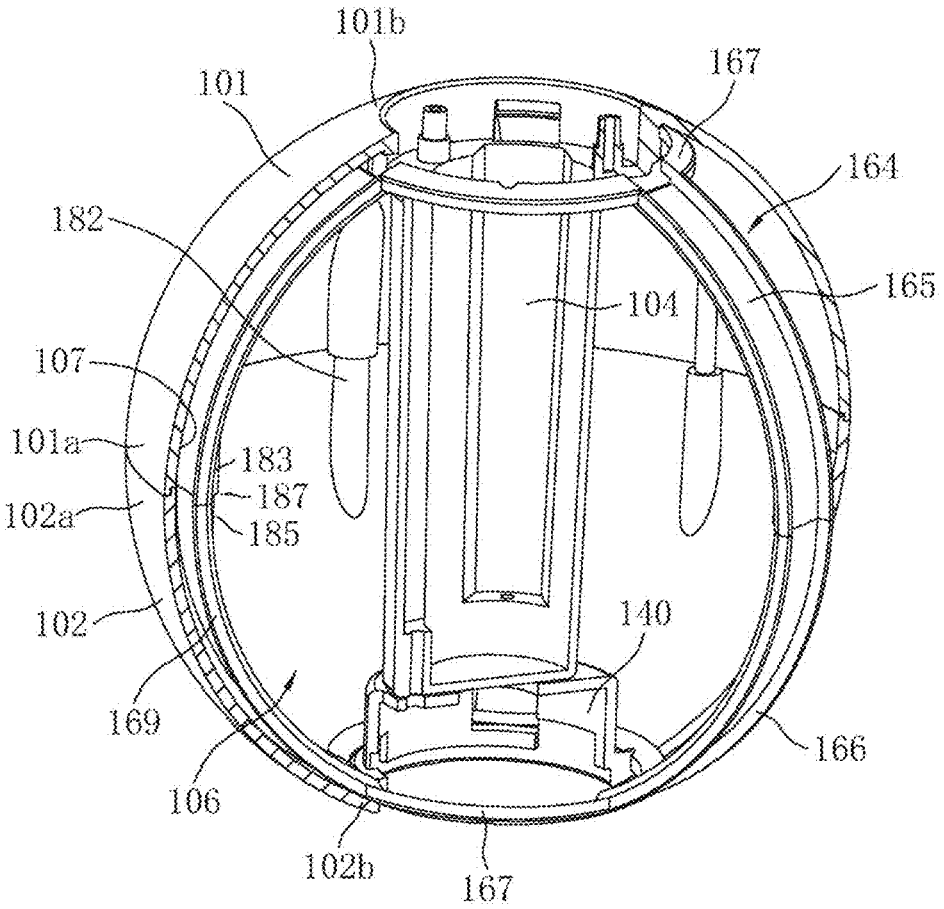
FIG. 19 is a schematic cross-sectional view of the support frame in FIG. 18 when being clamped in the first shell and the second shell.

FIG. 18 is a schematic view of another embodiment of the support frame 164. FIG. 19 is a schematic cross-sectional view when the support frame 164 in FIG. 18 is clamped in the first shell 101 in FIG. 15 and the second shell 102 in FIG. 16.

Referring to FIGS. 18 and 19, compared with the above embodiment, the main difference of the support frame 164 of this embodiment is that the second annular portion 168 is not formed on the support frame 164 of this embodiment. Specifically, in the example where the support frame 164 includes a first frame body 165 and a second frame body 166, the first frame body 165 includes a first annular portion 167 and a plurality of receiving portions 169, and the plurality of receiving portions 169 are arranged in the circumferential direction of the first annular portion 167. One end of each receiving portion 169 is connected to the first annular portion 167, and the other end extends in an arc shape and is cantilevered. The structure of the first annular portion 167 is substantially the same as that of the first annular portion 167 in the above embodiments, which will not be further described here. The main difference between the receiving portions 169 in this embodiment and the receiving portions 169 in the above embodiments is that the cantilever-shaped distal ends of the receiving portions 169 are formed with respective fifth bosses 183, and the fifth bosses 183 are formed with respective fifth positioning holes 184 extending in the first direction.

The second frame body 166 includes a first annular portion 167 and a plurality of receiving portions 169. The main difference between the second frame body 166 and the first frame body 165 is that the cantilever-shaped distal ends of the receiving portions 169 of the second frame body 166 are formed with respective sixth bosses 185, and the end surfaces of the sixth bosses 185 are formed with respective second positioning posts 186 extending in the first direction.

By inserting the second positioning posts 186 of the second frame body 166 into the respective fifth positioning holes 184 of the first frame body 165, the first frame body 165 and the second frame body 166 are engaged with each other, thereby forming the support frame 164. When the support frame 164 is received in the cavity 106, the first annular portion 167 of the first frame body 165 of the support frame 164 is arranged around the first mounting base 104 of the first bottom 101*b* of the first shell 101, and the first annular portion 167 of the second frame body 166 of the support frame 164 is arranged around the second mounting base 140 of the second bottom 102*b* of the second shell 102. The receiving portions 169 of the support frame 164 abut against the inner wall surface 107 of the cavity 106.

In addition, when the first frame body 165 and the second frame body 166 are engaged with each other, the fifth bosses 183 and the sixth bosses 185 are arranged opposite to each other and can form a reinforcement portion for the support frame 164 (also referred to as "second reinforcement portion 187" for ease of distinction). When the support frame 164 is received in the cavity 106, the second reinforcement portion 187 and the first reinforcement portion 182 are alternately distributed in the circumferential direction of the inner wall surface 107 of the cavity 106. Therefore, the first end 101*a* of the first shell 101 and the second end 102*a* of the second shell 102 are prevented from collapsing inward through the second reinforcement portion 187.

Compared with the above support frame 164 having the second annular portion 168, the structure of the support frame 164 of this embodiment is simpler, which can reduce the difficulty of processing the support frame 164 (for example, injection molding) and reduce the cost. In addition, the support frame 164 is clamped in the cavity 106 of the toy ball through the first annular portions 167. Since the second annular portion 168 is not formed, the receiving portions 169 of the support frame 164 are not secured with the first shell 101 or the second shell 102 of the toy ball. Therefore, the difficulty of mounting the support frame 164 can be reduced. Further, by forming the second reinforcement portion 187 at the receiving portions 169 of the support frame 164 that abut against the inner wall surface 107 of the cavity 106, not only can the overall strength of the support frame 164 be maintained, but also the support strength of the support frame 164 for the first end 101*a* of the first shell 101 and the second end 102*a* of the second shell 102 can also be maintained when the support frame 164 is received in the cavity 106 of the toy ball.

In addition, it is to be noted that in this embodiment, the support frame 164 can also be an integrally formed component, and in a case of being integrally formed, the support frame 164 also respectively includes two first annular portions 167 located at both ends and a plurality of receiving portions 169 connecting the two first annular portions 167. Moreover, each receiving portion 169 is also formed with a second reinforcement portion 187.

In the above embodiment, although the example in which the second shell 102 has the second mounting base 140 has been illustrated, it is not limited thereto. The second shell 102 may not be formed with the second mounting base 140 and may have a rounded hemispherical shell shape. In this case, the rope mounting portion 108 may be formed on the first cover 131. In addition, the rope 109 can also be directly mounted on the first shell 101 or the second shell 102. In this embodiment, for example, the rope mounting portion 108 can form a rope mounting hole (not shown in the figures) on the first shell 101 or the second shell 102, so as to mount the rope 109.

In the above embodiment, although the example in which the rope 109 is mounted to the second cover 153 through the first joint 158 has been illustrated, it is not limited thereto. The second cover 153 may not be provided with the first joint 158, but only a rope mounting hole may be formed. In this case, the rope 109 may pass through the rope mounting hole and be knotted, thereby being secured to the second cover 153. Alternatively, even in the case where the second cover 153 is provided with the first joint 158, a rope 109 with a smaller diameter may be selected, and the rope 109 is mounted to the first joint 158 by knotting.

In addition, in the above embodiment, although the example in which one end of the rope 109 is mounted on the toy ball has been illustrated, it is not limited thereto. Both ends of the rope 109 may also be mounted on the toy ball.

In the above embodiment, although the example in which the toy ball has the rope mounting portion 108 has been illustrated, it is not limited thereto. For example, in a case of being used as the juggling ball, the toy ball may not have the rope mounting portion 108.

Although the embodiments have been shown and described, a person of ordinary skill in the art may understand that various changes, modifications, substitutions, and variations may be made to these embodiments without departing from the principles and purposes of the embodiments, the scope of which is defined by the claims and their equivalents.

What is claimed is:

1. A toy ball, comprising:

a first shell and a second shell capable of being fitted with each other and forming a cavity inside;

a first mounting base, accommodated in the cavity;

a support frame, disposed in the cavity and supporting the first shell and the second shell;

a plurality of first light-emitting elements, spaced apart in the cavity in a circumferential direction at ends of the first shell and the second shell where the first shell and the second shell are fitted with each other, each of the first light-emitting elements being secured to the support frame; and a control device, mounted on the first mounting base and electrically connected to the first light-emitting elements.

2. The toy ball according to claim 1, wherein the support frame comprises:

two first annular portions, respectively clamped on one side of a first bottom of the first shell and one side of a second bottom of the second shell, wherein the first bottom is located at one end of the toy ball in a first direction, the second bottom is located at the other end of the toy ball in the first direction, and the first direction is parallel to a direction in which the first shell and the second shell are fitted with each other; and a plurality of receiving portions, respectively connected to the two first annular portions and extending from one side of the first bottom to one side of the second bottom along an inner wall surface of the cavity.

3. The toy ball according to claim 2, wherein each of the first light-emitting elements has a base and a plurality of first light beads carried on the base;

the base is fixed to the respective receiving portion, and the first light beads face the inner wall surface of the cavity.

4. The toy ball according to claim 3, wherein the base extends from one side of the first bottom to one side of the second bottom along the inner wall surface.

5. The toy ball according to claim 2, wherein in a case that the first shell and the second shell are fitted with each other, the plurality of receiving portions respectively abut, inside the cavity, against the ends of the first shell and the second shell where the first shell and the second shell are fitted with each other.

6. The toy ball according to claim 2, wherein the support frame further comprises a second annular portion located between the two first annular portions in the first direction, and the second annular portion is secured with the ends of the first shell and the second shell where the first shell and the second shell are fitted with each other.

7. The toy ball according to claim 6, wherein in a case that the first shell and the second shell are fitted with each other, a first end of the first shell abuts against a second end of the second shell, and the second annular portion abuts against the first end and the second end inside the cavity.

8. The toy ball according to claim 2, wherein the first mounting base is integrally formed with the first shell and extends from the first bottom of the first shell in the first direction;

the toy ball further comprises a second mounting base that is integrally formed with the second shell and extends from the second bottom of the second shell in the first direction;

the first mounting base and the second mounting base are aligned and secured with each other in the first direction; and one of the two first annular portions is clamped to the first mounting base, and the other is clamped to the second mounting base.

9. The toy ball according to claim 1, wherein the first mounting base defines a first mounting cavity in the cavity, and is formed with first mounting posts on one side of the first mounting cavity;

the toy ball further comprises a first cover that covers the first mounting cavity and is formed with second mounting posts;

the control device comprises a circuit board mounted in the first mounting cavity, and when the first cover covers the first mounting cavity, the second mounting posts and the first mounting posts cooperatively position and clamp the circuit board.

10. The toy ball according to claim 8, wherein the second mounting base defines a second mounting cavity in the cavity;

the toy ball further comprises a second cover that covers the second mounting cavity and is formed with a rope mounting portion for mounting a rope extending outward; and the second cover is secured with the first mounting base and the second mounting base.

11. A toy ball, comprising:

a first shell and a second shell capable of being fitted with each other and forming a cavity inside;

a plurality of first light-emitting elements, spaced apart in the cavity in a circumferential direction at ends of the first shell and the second shell where the first shell and the second shell are fitted with each other;

a first mounting base, accommodated in the cavity; and a control device, mounted on the first mounting base and electrically connected to the first light-emitting elements.

12. The toy ball according to claim 11, further comprising a support frame disposed in the cavity, wherein the plurality of first light-emitting elements are respectively secured to the support frame.

13. The toy ball according to claim 12, wherein each of the first light-emitting elements has a base and a plurality of first light beads carried on the base;

the base is attached to the support frame, and the first light beads face an inner wall surface of the cavity.

14. The toy ball according to claim 13, wherein the base extends from one end of the cavity in a first direction to the other end of the cavity in the first direction along the inner wall surface, wherein the first direction is parallel to a direction in which the first shell and the second shell are fitted with each other.

15. The toy ball according to claim 13, wherein the first mounting base is integrally formed with the first shell, and the first mounting base defines a first mounting cavity in the cavity; and the control device comprises a circuit board mounted in the first mounting cavity.

16. The toy ball according to claim 15, wherein first notches are formed in the first mounting base, and the first notches connect the cavity and the first mounting cavity; and the first light-emitting elements are electrically connected to the circuit board through first wires passing through the respective first notches.

17. The toy ball according to claim 15, further comprising a first cover covering the first mounting cavity;

the first mounting base is formed with first mounting posts on one side of the first mounting cavity, the first cover is formed with second mounting posts, and when the first cover covers the first mounting cavity, the second mounting posts and the first mounting posts cooperatively position and clamp the circuit board.

18. The toy ball according to claim 15, wherein the second shell is integrally formed with a second mounting base that defines a second mounting cavity in the cavity;

the toy ball further comprises a second cover that covers the second mounting cavity and is removable; and the toy ball is formed with a rope mounting portion for mounting a rope extending outward, and the rope mounting portion is formed on the second cover.

19. The toy ball according to claim 18, wherein the rope mounting portion comprises a first joint disposed on the second cover, and the first joint is configured to pluggably mount one end of the rope.

20. The toy ball according to claim 19, wherein the rope has a light guide portion; and a second light-emitting element is mounted in the second mounting cavity, and when one end of the rope is mounted to the first joint, the second light-emitting element faces the light guide portion.

* * * * *